US007619533B2

(12) United States Patent
Crucilla

(10) Patent No.: US 7,619,533 B2
(45) Date of Patent: Nov. 17, 2009

(54) METHOD AND APPARATUS FOR MONITORING PERSONS

(75) Inventor: Christopher Crucilla, Douglas, AZ (US)

(73) Assignee: Streetime Technologies LLC, Easton, CT (US)

( * ) Notice: Subject to any disclaimer, the term of this patent is extended or adjusted under 35 U.S.C. 154(b) by 235 days.

(21) Appl. No.: 11/650,771

(22) Filed: Jan. 6, 2007

(65) Prior Publication Data

US 2007/0159343 A1 Jul. 12, 2007

Related U.S. Application Data

(60) Provisional application No. 60/756,843, filed on Jan. 7, 2006.

(51) Int. Cl.
*G08B 23/00* (2006.01)

(52) U.S. Cl. ..... 340/573.4; 340/539.13; 340/825.49; 340/573.1

(58) Field of Classification Search ..... 340/573.4, 340/539.13, 825.49, 573.1, 825.69, 825.72; 342/357.01, 357.06, 357.07, 357.08, 357.09
See application file for complete search history.

(56) References Cited

U.S. PATENT DOCUMENTS

| | | | | |
|---|---|---|---|---|
| 5,867,103 | A | 2/1999 | Taylor | |
| 6,072,396 | A | 6/2000 | Gaukel | |
| 6,100,806 | A | 8/2000 | Gaukel | |
| 6,437,696 | B1 * | 8/2002 | Lemelson et al. | 340/573.4 |
| 6,559,769 | B2 * | 5/2003 | Anthony et al. | 340/574 |
| 7,466,224 | B2 * | 12/2008 | Ward et al. | 340/522 |
| 2003/0030569 | A1 * | 2/2003 | Ulrich et al. | 340/825.49 |
| 2004/0021573 | A1 * | 2/2004 | Hoffman et al. | 340/573.1 |

* cited by examiner

*Primary Examiner*—Anh V La
(74) *Attorney, Agent, or Firm*—Knechtel, Demeur & Samlan

(57) ABSTRACT

A method and apparatus for monitoring persons for compliance with a conditional release program from their court ordered confinement. The individual to be monitored is added to the system and assigned a schedule or treatment plan which provides for allowed location and disallowed locations. A monitoring device is used to monitor the positional locations and other relevant information of the individual. This information is collected and analyzed in the system to determine if the individual is in compliance with their schedule or treatment plan. Reports of the results of the analysis of the compliance are created and sent to the customer responsible for the individual during their conditional release program.

17 Claims, 21 Drawing Sheets

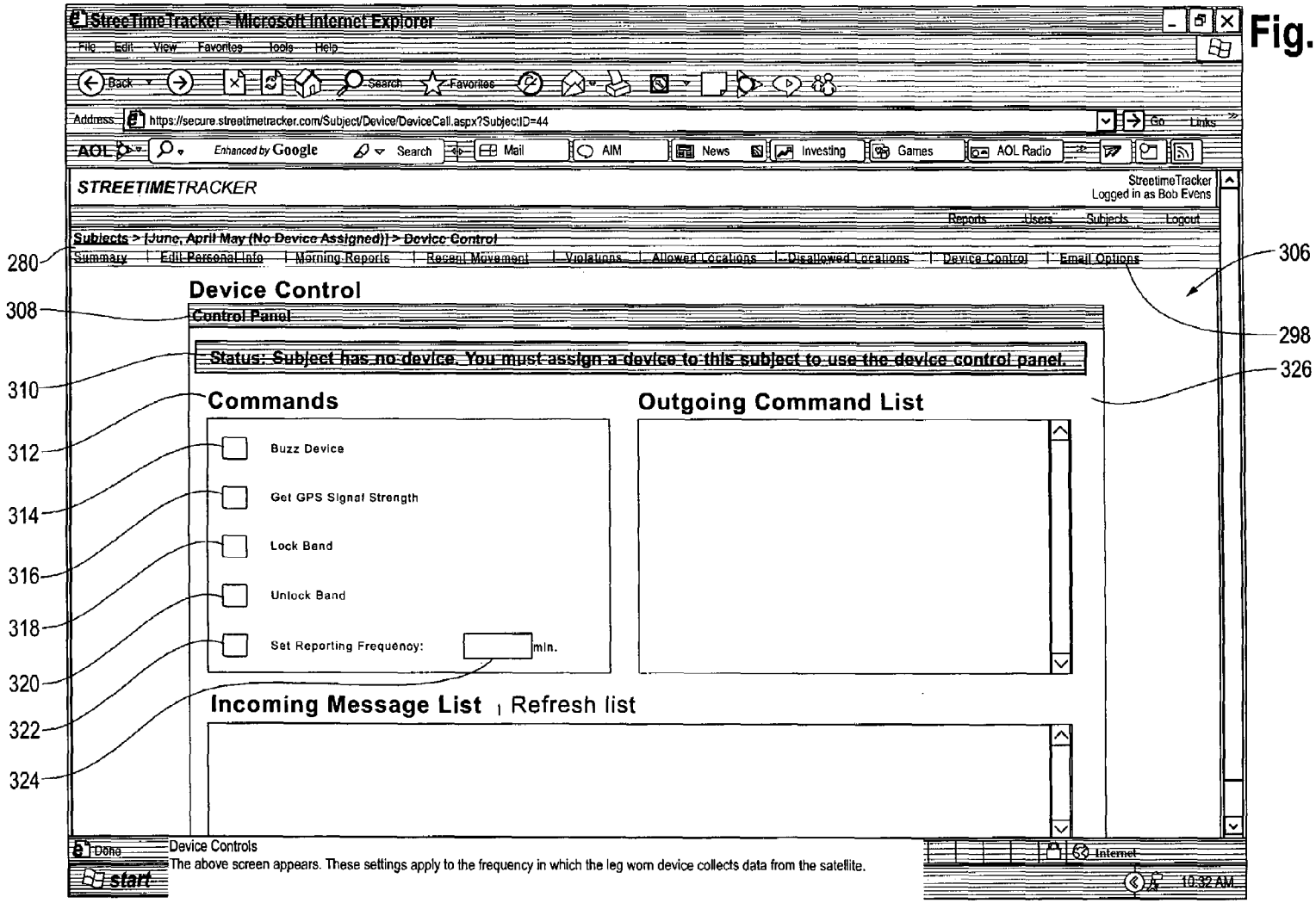
Fig. 13
StreetTimeTracker - Microsoft Internet Explorer
File Edit View Favorites Tools Help
Back Search Favorites
Address https://secure.streettimetracker.com/Subject/Device/DeviceCall.aspx?SubjectID=44
AOL Enhanced by Google Search Mail AIM News Investing Games AOL Radio Go Links
STREETTIMETRACKER
StreetimeTracker
Logged in as Bob Evens
Subjects > June, April May (No Device Assigned) > Device Control
Reports Users Subjects Logout
Summary Edit Personal Info Warning Reports Recent Movement Violations Allowed Locations Disallowed Locations Device Control Email Options
Device Control
Control Panel
Status: Subject has no device. You must assign a device to this subject to use the device control panel.
Commands
Buzz Device
Get GPS Signal Strength
Lock Band
Unlock Band
Set Reporting Frequency:
min.
Outgoing Command List
Incoming Message List
Refresh list
Device Controls
The above screen appears. These settings apply to the frequency in which the leg worn device collects data from the satellite.
Internet
10:32 AM
start
280
308
310
312
314
316
318
320
322
324
298
306
326

METHOD AND APPARATUS FOR MONITORING PERSONS

CROSS-REFERENCE TO RELATED APPLICATION

This patent application is a non-provisional application claiming priority from U.S. Provisional Patent Application Ser. No. 60/756,843, entitled "Method and Apparatus For Monitoring Persons,"filed on Jan. 7, 2006, and is fully incorporated herein by reference.

I. FIELD OF THE INVENTION

The present invention relates to monitoring systems and, more particularly, to a monitoring system that is designed for tracking an individual's compliance with a conditional release program from their court ordered confinement.

II. DESCRIPTION AND BACKGROUND OF THE INVENTION

When an individual is conditionally released from their Court ordered confinement, the individual is permitted to return to society subject to a probationary period. For example, an individual released from prison on parole is referred to as a "parolee"; an individual released from jail on probation is referred to as a "probationer"; and an individual released from Court supervision on drug related crimes is referred to as a "drug court participant." During this probationary period, the individual will be assigned a probation officer or other personnel and required to comply with an approved schedule. The schedule includes at least a treatment plan, approved or permitted locations where the individual may live, and approved or permitted times and locations where the individual may go and/or visit during the day or evening.

Under the treatment plan, the individual, depending upon the circumstances surrounding the reasons for their incarceration or illegal activities, will be required to comply with certain treatments that are specifically designed to assist the individual in overcoming their problems. For example, if the individual is a drug or alcohol addict, the individual may be required to regularly attend alcoholics anonymous, narcotics anonymous sessions, and/or drug and alcohol education classes; if the individual is a sex offender or has another type of problem, the individual may be required to attend individual counseling, group therapy sessions, or comply with any other type of applicable treatment. If the individual complies with their schedule and treatment plan, it is intended and hoped that the schedule deterred the individual from re-committing any of their illegal activities and the treatment plan was successful in rehabilitating or continuing to rehabilitate the individual.

In the past, the only means available to confirm the individual's compliance with the treatment plan was to receive from the individual, at prearranged times, a land line telephone call from designated locations by the individual. If the individual complied, the individual was in compliance. If the individual did not comply, the individual was not in compliance and possibly subject to disciplinary action such as revoking the individual's release and returning the individual back to their Court ordered confinement. The problem, however, is that unless the probation officer conducts an actual visit of the individual during the day or evening, the probation officer would have no real knowledge of the whereabouts or activities of the individual during these time periods. This is particularly troublesome as the probation officer would not be aware if the individual was visiting certain acquaintances or frequenting certain places or area which may allow the individual the opportunity to re-commit any of the illegal activities for which they are serving time. The probation officer also would not be aware of such movement to circumvent such activities from occurring.

Since then, devices have been designed to track such individuals during these types of conditional release programs. Examples of such devices are disclosed in U.S. Pat. Nos. 6,100,806 and 6,072,396, each entitled "Apparatus and Method For Continuous Electronic Monitoring and Tracking of Individuals"; and U.S. Pat. No. 5,867,103 entitled "Monitored Person Tracking System." These devices generally disclose a portable monitoring device that is secured to each monitored person. The portable monitoring devices receive a signal from a satellite or other positioning means and transmit this and other information to a central location. A position reference or location of the monitored person is determined from the positioning means and this information is stored in a database for tracking the individual's exact position throughout each and every day. One main objective of these devices is to use the continuous tracking of the individual's exact location as evidence to support a possible legal proceeding against the individual should the individual commit an illegal act during their release.

While the above devices are useful for their intended purpose, they are not designed to monitor an individual's compliance with a schedule and/or treatment plan that has been implemented during the conditional release program to address that individual's particular problems.

Thus, there is a need and there has never been disclosed Applicant's unique method and apparatus for monitoring persons for compliance with the conditional release program from their court ordered confinement.

III. SUMMARY OF THE INVENTION

The present invention is a method and apparatus for monitoring persons for compliance with a conditional release program from their court ordered confinement. The individual to be monitored is added to the system and assigned a schedule or treatment plan which provides for allowed location and disallowed locations. A monitoring device is used to monitor the positional locations and other relevant information of the individual. This information is collected and analyzed in the system to determine if the individual is in compliance with their schedule or treatment plan. Reports of the results of the analysis of the compliance are created and sent to the customer responsible for the individual during their conditional release program.

IV. BRIEF DESCRIPTION OF THE DRAWINGS

The Description of the Preferred Embodiment will be better understood with reference to the following figures:

FIG. 13 is a diagram of the device control screen for the computer software system.

Figure 19A:
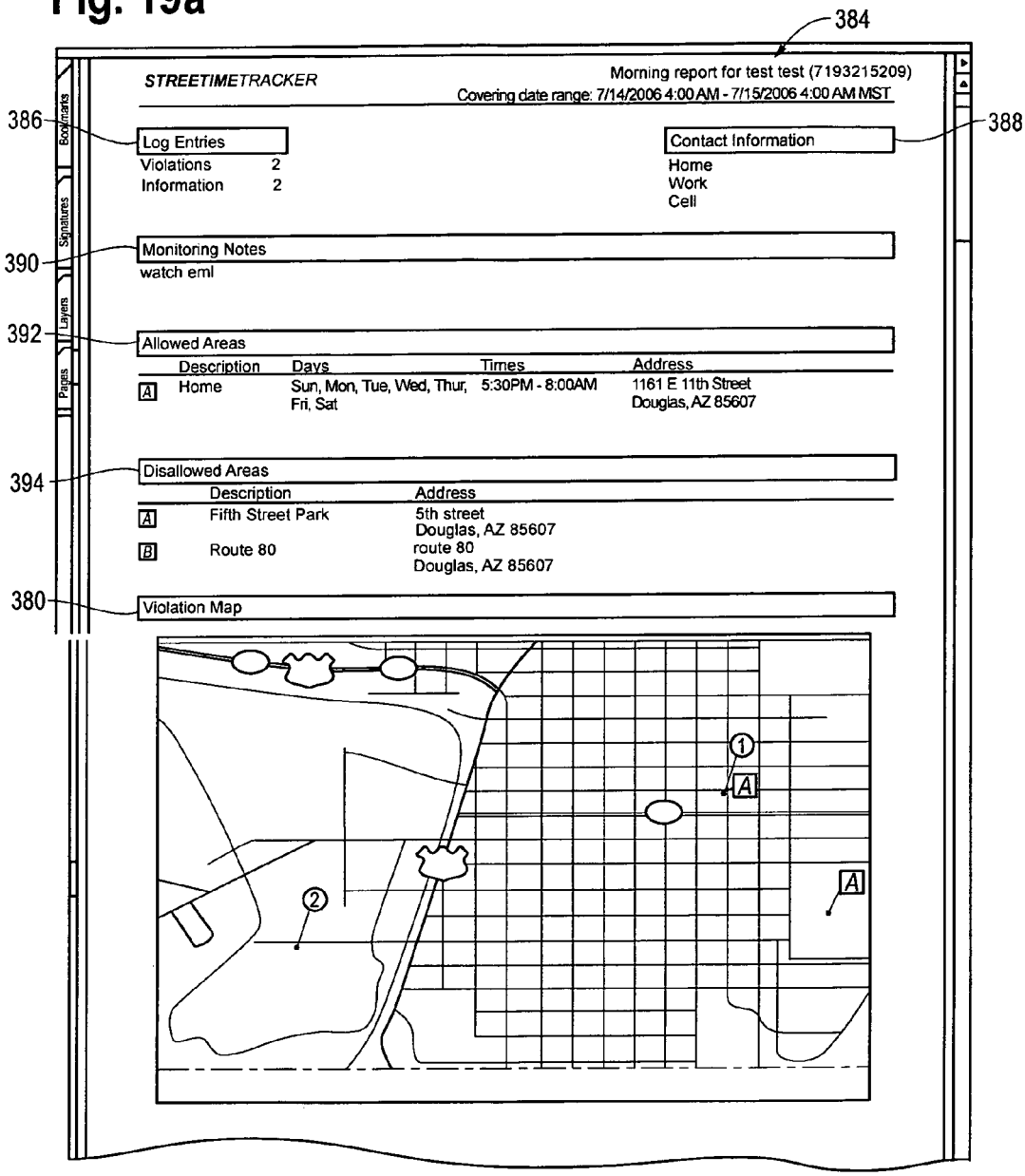
Figure 19B:
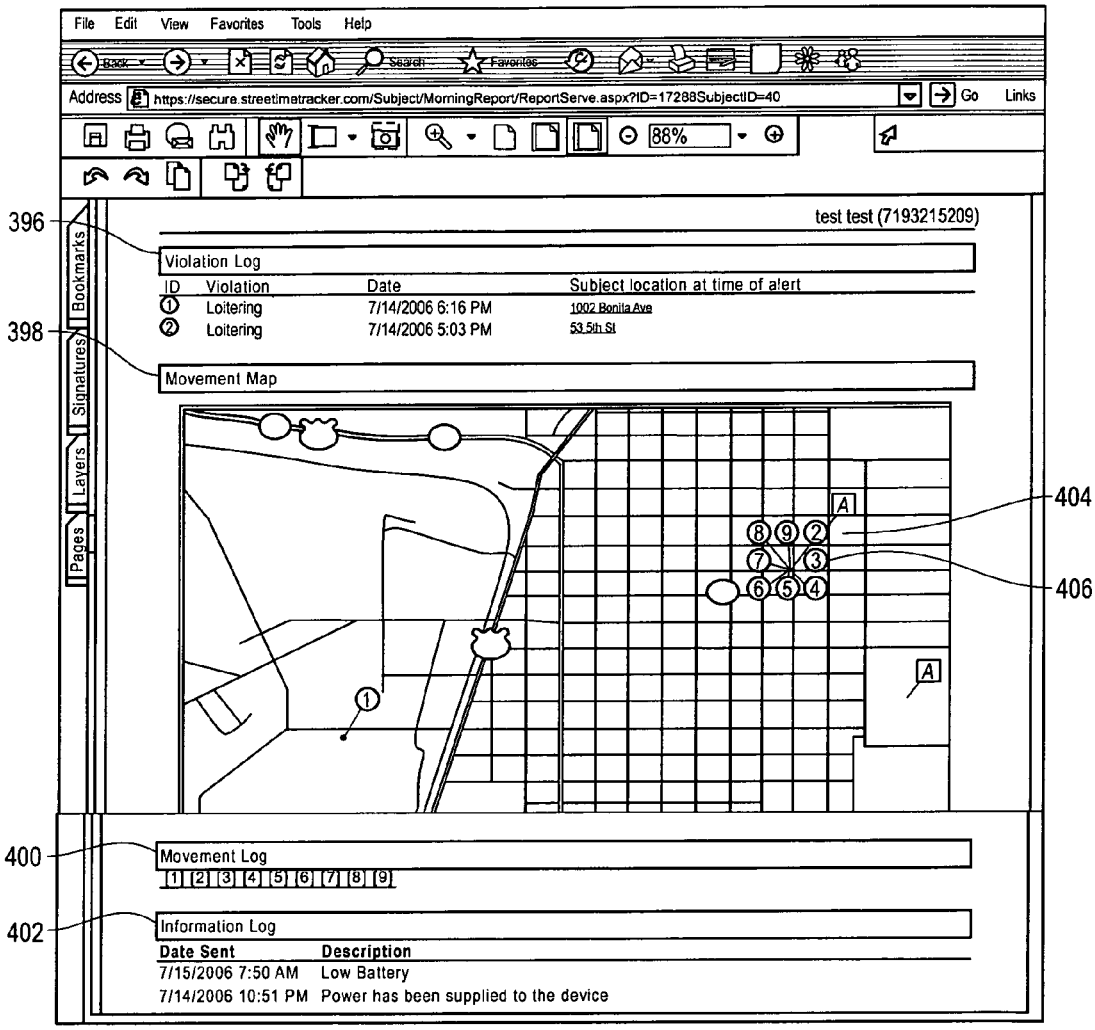

FIGS. 19*a* and 19*b* are a diagram of the morning report screen for the computer software system.

Figure 20:
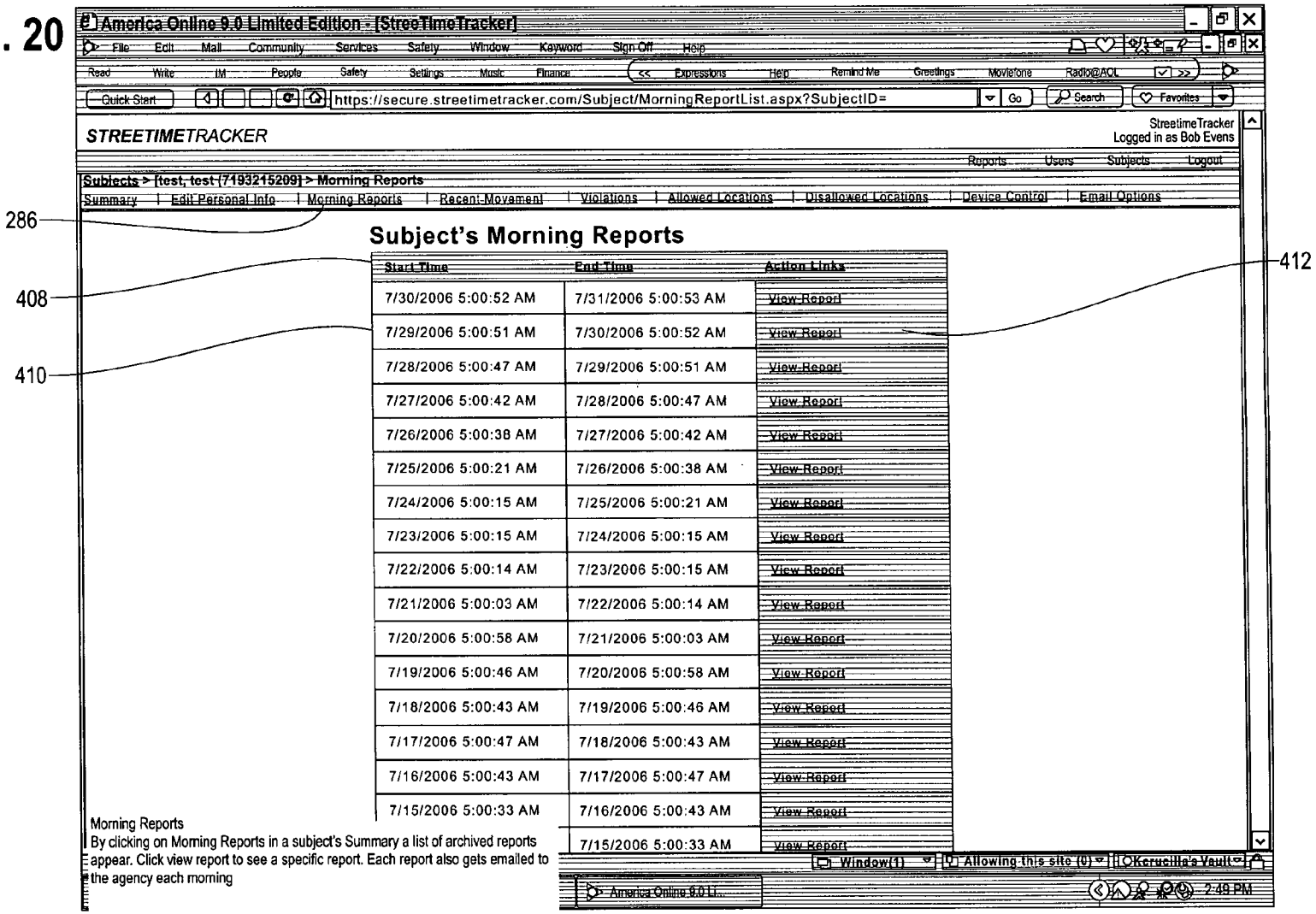

FIG. 20 is a diagram of the subject's morning reports screen for the computer software system.

V. DETAILED DESCRIPTION OF THE PREFERRED EMBODIMENT

Figure 1:
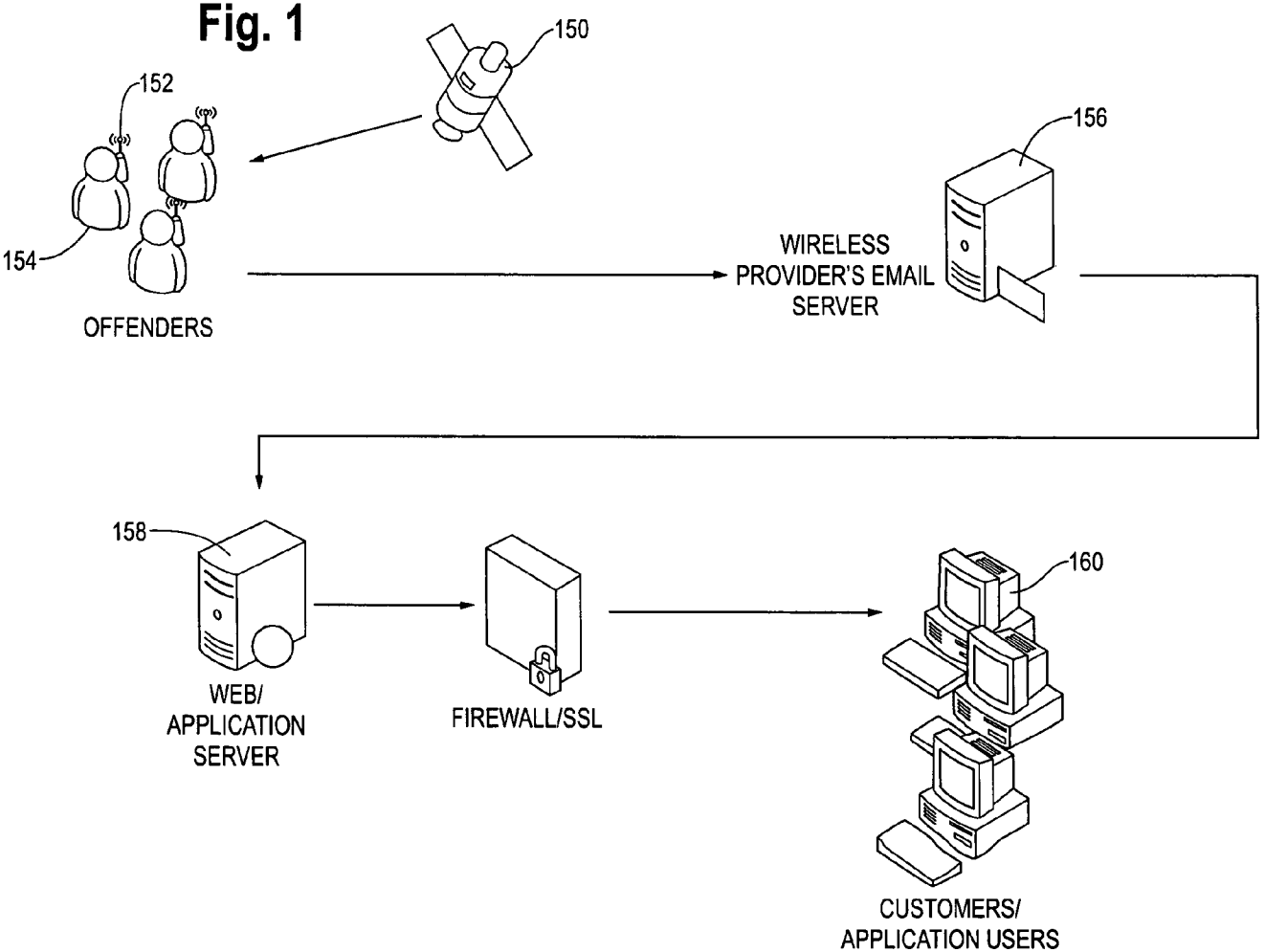
FIG. 1 is a diagram illustrating the computer hardware used in Applicant's system.
Figure 2:
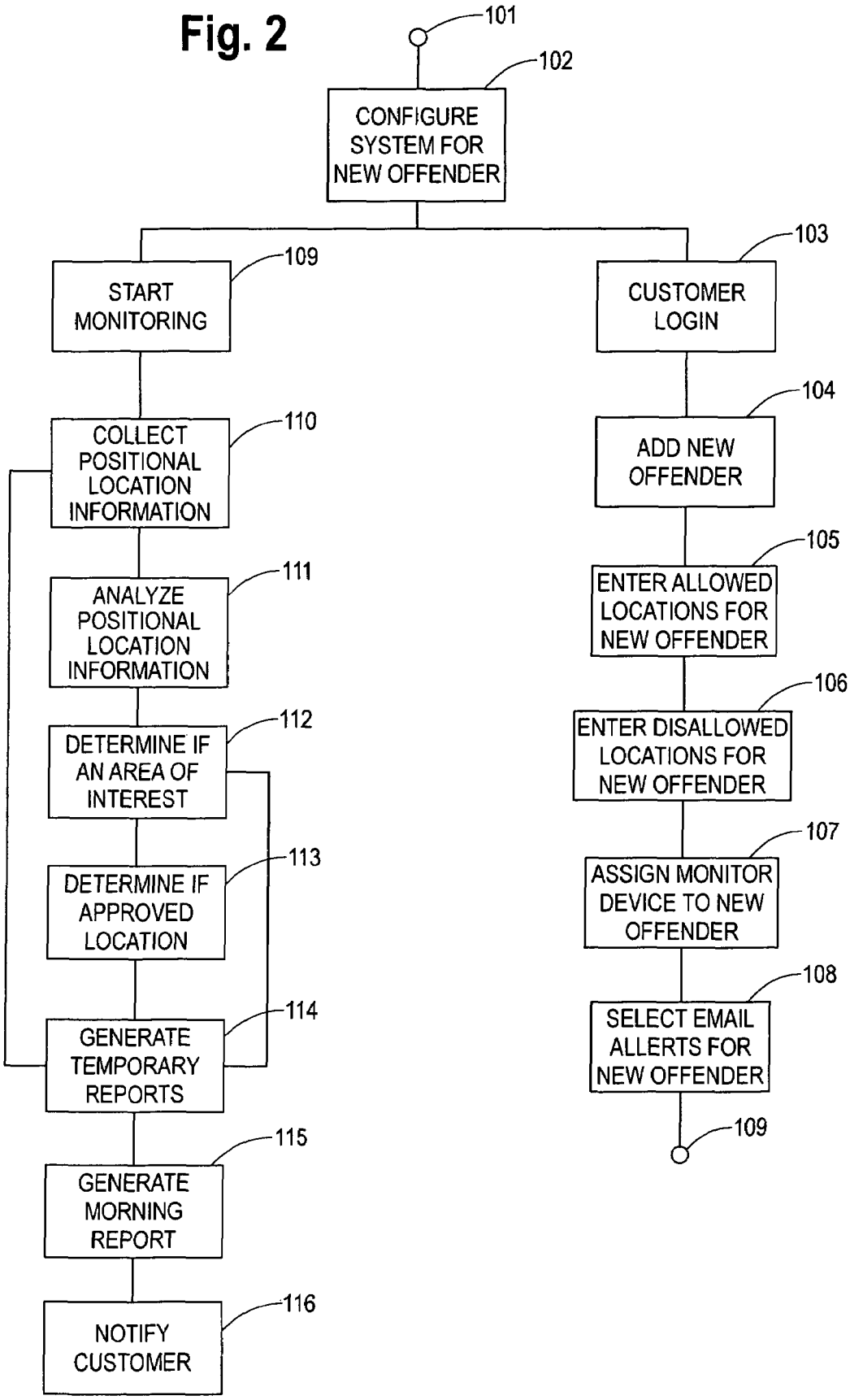
FIG. 2 is a flowchart illustrating the basic operation of Applicant's computer software system.

Applicant's invention consists of the interaction between computer hardware, as illustrated in FIG. 1, and computer software system ("system"), as illustrated in FIG. 2.

Turning to FIG. 1, the computer hardware consists of a global positioning means 150, a monitoring device 152 attached to an Offender 154, an email server 156, a web/application server 158, and a customer computer 160.

In the preferred embodiment, the global positioning means 150 is a global positioning system of satellites which is well known in the art for determining the positional location for a monitoring device. Alternatively, the global positioning means 150 may be any means known to one skilled in the art which may be employed, used, or adapted for use with Applicant's invention.

The email server 156 is used to send and receive email communications to and from the monitoring device 152 and the web/application server 158. Preferably, the email server 156 uses Windows 2003 SP1 and a Rockliffe MailSite 7.

The web/application server 158 is used to host a .NET web application and a Windows service. The .NET web application interfaces with a SQL server database to store, manage, and/or retrieve any or all communications, information, and/or data for the system. The .NET web application is also used by the customers of the customer computer 160 to interface with the web/application server 158 to monitor the Offenders 154 in the system. The Windows service is constantly running to facilitate all communication between the .NET web application and the other tether devices, processing and analyzing the communications received by the tether devices, and appropriately reacting to the analysis of the communications received by the tether devices. For example, the Windows service interfaces with the email server 156 to send and receive email communications and interfaces with the SQL server database to store and retrieve data. Preferably, the web/application server 158 uses Windows 2003 SP1 and IIS 6.0 (.NET 2.0).

The customer computer 160 is used to interface with the .NET web application on the web/application server 158. The customer computer 160 preferably provides Microsoft Windows XP and Microsoft Internet Explorer 6 or higher as the internet browser.

Alternatively, any means known to one skilled in the art may be used as the email server 156, web/application server 158, and customer computer 160 provided that this means is used in the same manner to accomplish Applicant's invention.

Also, as computer hardware and their components are well known in the art and it is contemplated that any compatible type, version, or size made by any manufacturer and applicable software for the computer hardware to interface or communicate with one another is acceptable to accomplish the intended purposes of Applicant's invention.

Turning to FIG. 2, there is illustrated a schematic diagram of the basic operation of a unique method and apparatus for monitoring persons.

In Step 101, the process for monitoring persons begins. If an individual or offender has been conditionally released from their Court ordered confinement and this individual or offender is required to be monitored during their conditional release program, proceed to Step 102. In the preferred embodiment, the individual or offender may include but is not limited to a parolee, a probationer, a drug court participant, and/or any other person that is under some form of conditional release program which requires the person to be monitored (all such persons are hereinafter referred to as "Offender").

In Step 102, if the system is to be configured for a new Offender 154, proceed to Step 103 to configure the system for the new Offender 154. If the system does not need to be configured for a new Offender 154, proceed to Step 109.

Figure 3:
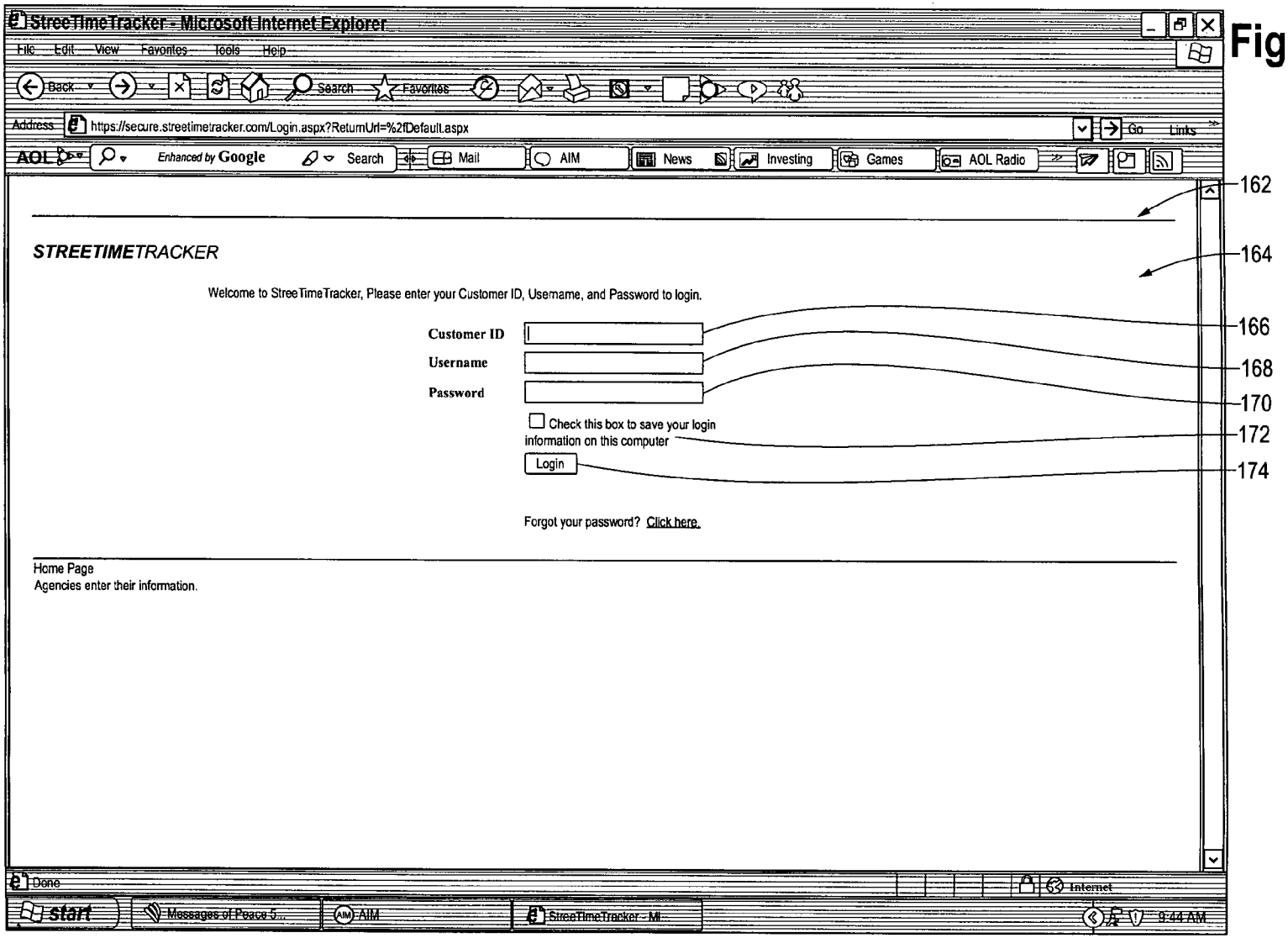
FIG. 3 is a diagram of the login interface screen for the computer software system.

In Step 103, to configure the system for the new Offender 154, the customer will use web/application server software 162 ("software 162"), as illustrated in FIG. 3. In the preferred embodiment, the software 162 is installed and run on the web/application server 158. The software 162 displays a login interface 164 which provides a customer id prompt 166, a username prompt 168, a password prompt 170, a save check box 172, and a login button 174.

In the preferred embodiment, the customer id is a unique identification for the name of the customer such as a probation officer or any other entity that is responsible for monitoring or tracking the Offender 154. The username is a unique identification for each person that is employed by, an agent, or in some way affiliated with the customer and requires access to the system. The password is a unique identification that is maintained in secret and known only to the user of the customer account for accessing the system.

Entering the correct combination of customer id, username, and password in the customer id prompt 166, the username prompt 168, and the password prompt 170 and then selecting the login button 174 will gain access into the system. If the correct combination of customer id, username, and password are to be saved for later retrieval, entering a check mark into the save check box 172 will save this login information.

Figure 4:
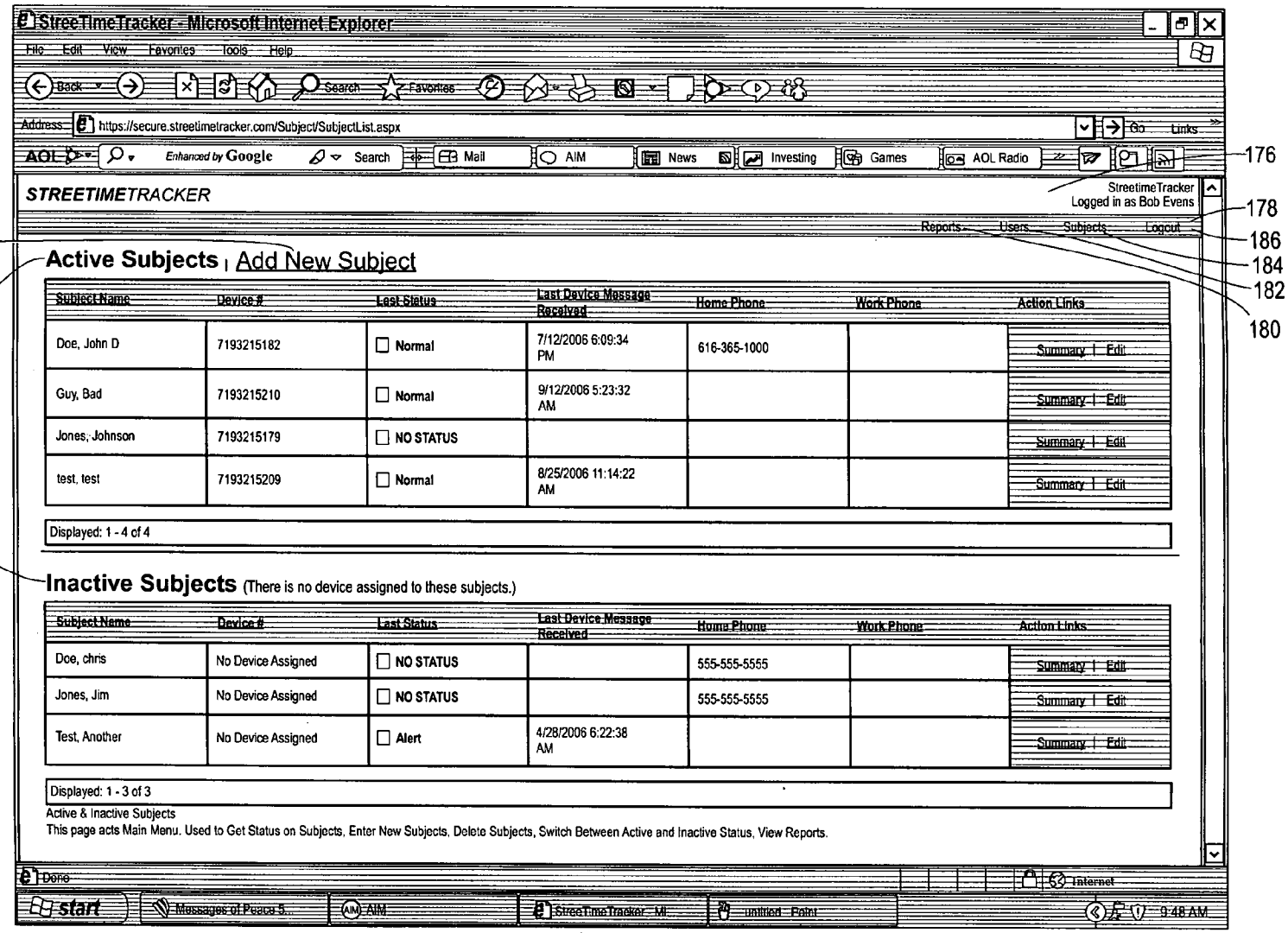
FIG. 4 is a diagram of the home interface screen for the computer software system.

When completed and successfully logged into the system, proceed to Step 104. In Step 104, upon logging into the system, a home interface screen 176, as illustrated in FIG. 4, is displayed. The new Offender 154 is then to be entered into the system. The home interface screen 176 provides a menu bar 178. The menu bar 178 comprises a reports heading 180, a users heading 182, a subjects heading 184, and a logout heading 186. The home interface screen 176 also provides an active subjects pane 188 and an inactive subjects pane 190. The active subjects pane 188 identifies the Offenders 154 which are currently being monitored in the system. The inactive subjects pane 190 identifies the Offenders 154 which are configured into the system but not being monitored at this time.

Figure 5:
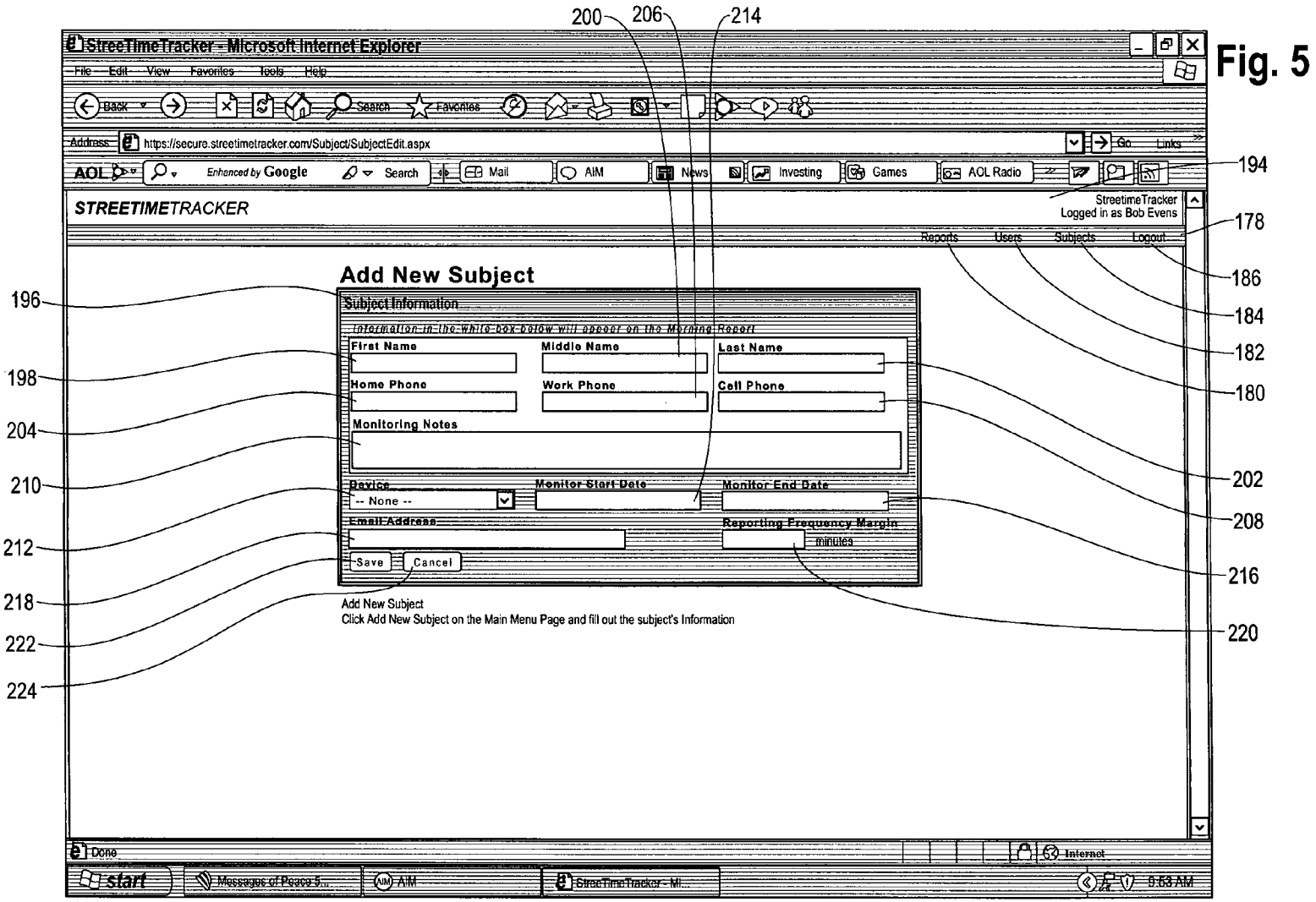
FIG. 5 is a diagram of the add new subject screen for the computer software system.

The active subjects pane 188 provides an add new subject link 192. The add new subjects link 192 permits a new Offender 154 to be added into the system to be monitored. Selecting the add new subjects link 192 proceeds to the add new subject screen 194, as illustrated in FIG. 5. Alternatively, the add new subject screen 194 may be loaded using the menu bar 178. Selecting the subjects heading 184 will also enable one through a drop down menu to automatically proceed from the home interface screen 176 to the add new subject screen 194.

The add new subject screen 194 is where the information relating to the new Offender 154 is entered in the system. The add new subject screen 194 provides the same menu bar 178 as previously described. The add new subject screen 194 also provides an add new subject information pane 196. The add new subject information pane 196 provides a first name prompt 198, a middle name prompt 200, a last name prompt 202, a home phone prompt 204, a work phone prompt 206, a cell phone prompt 208, a monitoring notes prompt 210, a device prompt 212, a monitor start date prompt 214, a monitor end date 216, an e-mail address prompt 218, a reporting frequency margin prompt 220, and a save button 222 and cancel button 224.

Figure 6:
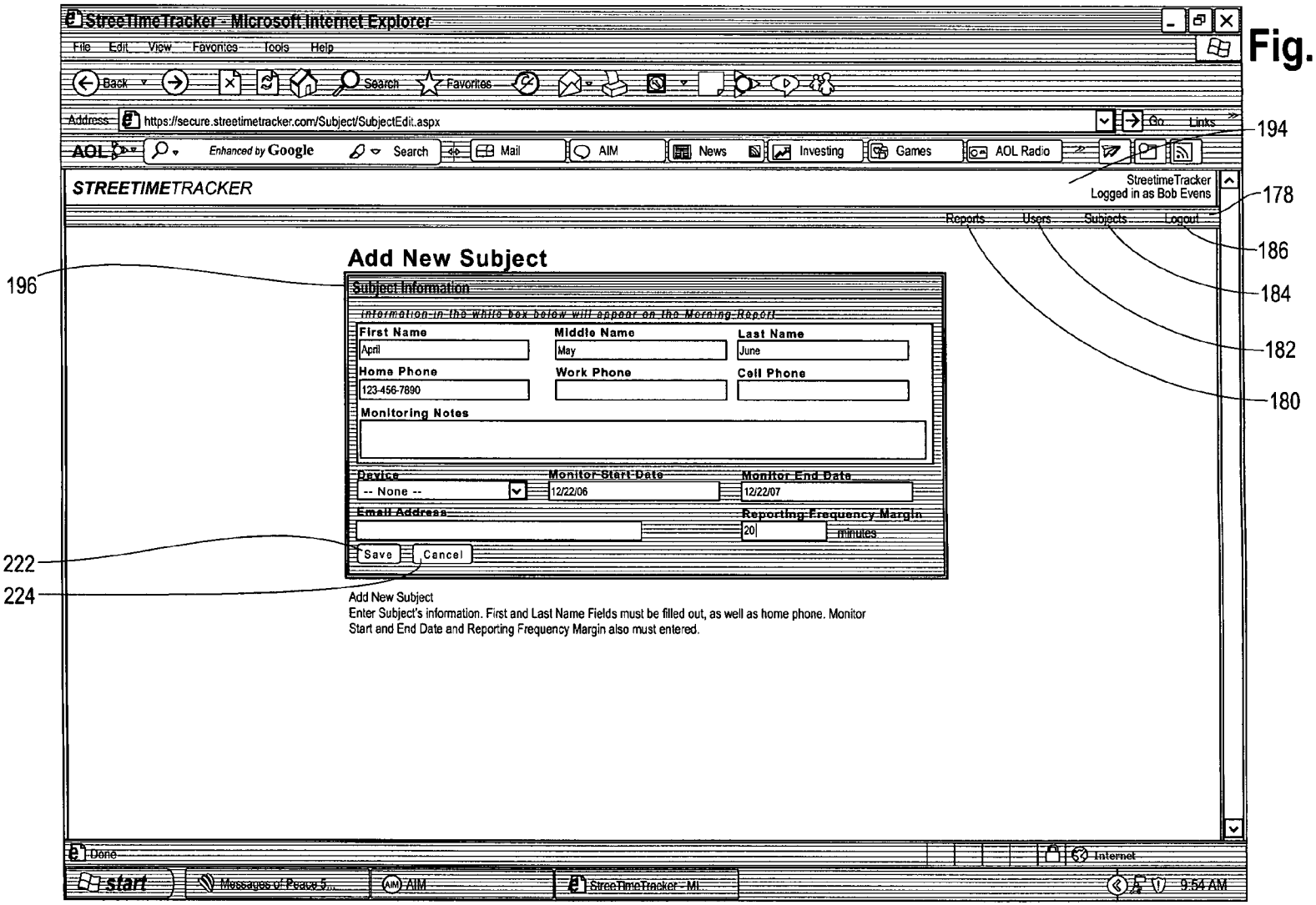
FIG. 6 is a diagram of the add new subject information pane of the add new subject screen for the computer software system.

To enter a new Offender 154 into the system, enter the first name, middle name, last name, home phone, work phone, cell phone, and e-mail address for the Offender 154 into the respective like named prompts. If there is particular information that should be known regarding the Offender 154, enter this information into the monitoring notes prompt 210. If available at this time, enter the unique identification number for the monitoring device 152 in the device prompt 212. In the preferred embodiment, each monitoring device 152 for the Offender 154 is provided with a unique identification number to associate all the monitoring information in the system from each monitoring device 152 with a particular Offender 154. Enter the month, day, and year in the (mm/dd/yyyy) format into the monitoring start date prompt 214. This represents the day that the system will begin to monitor the Offender 154. Enter the month, day, and year in the (mm/dd/yyyy) format into the monitoring end date prompt 216. This represents the day that the system will stop monitoring the Offender 154 such as when the Offender 154 successfully completes their conditional release program, is returned to Court ordered confinement for failing to comply with their conditional release program, or any other reason that the Offender 154 is no longer in the conditional release program or required to be monitored. Enter the number of minutes that the monitoring device 152 is to report to the system in the reporting frequency margin prompt 220. This represents the frequency that the monitoring device sends information to the system. Upon entering the above information, an example of a new Offender 154 by the name of "April May June" is illustrated in FIG. 6.

Upon entering all of the information, select the save button 222. If any of the subject information in the add new subject information pane 196 was entered inadvertently, by mistake, or in error, selecting the cancel button 224 will cancel the action. When completed, proceed back to the home interface screen 176, as illustrated in FIG. 7.

Alternatively, the home interface screen 176 may be returned to and loaded using the menu bar 178. Selecting the subjects heading 184 will also enable one through a drop down menu to automatically proceed from the add new subject screen 194 back to the home interface screen 176.

Figure 7:
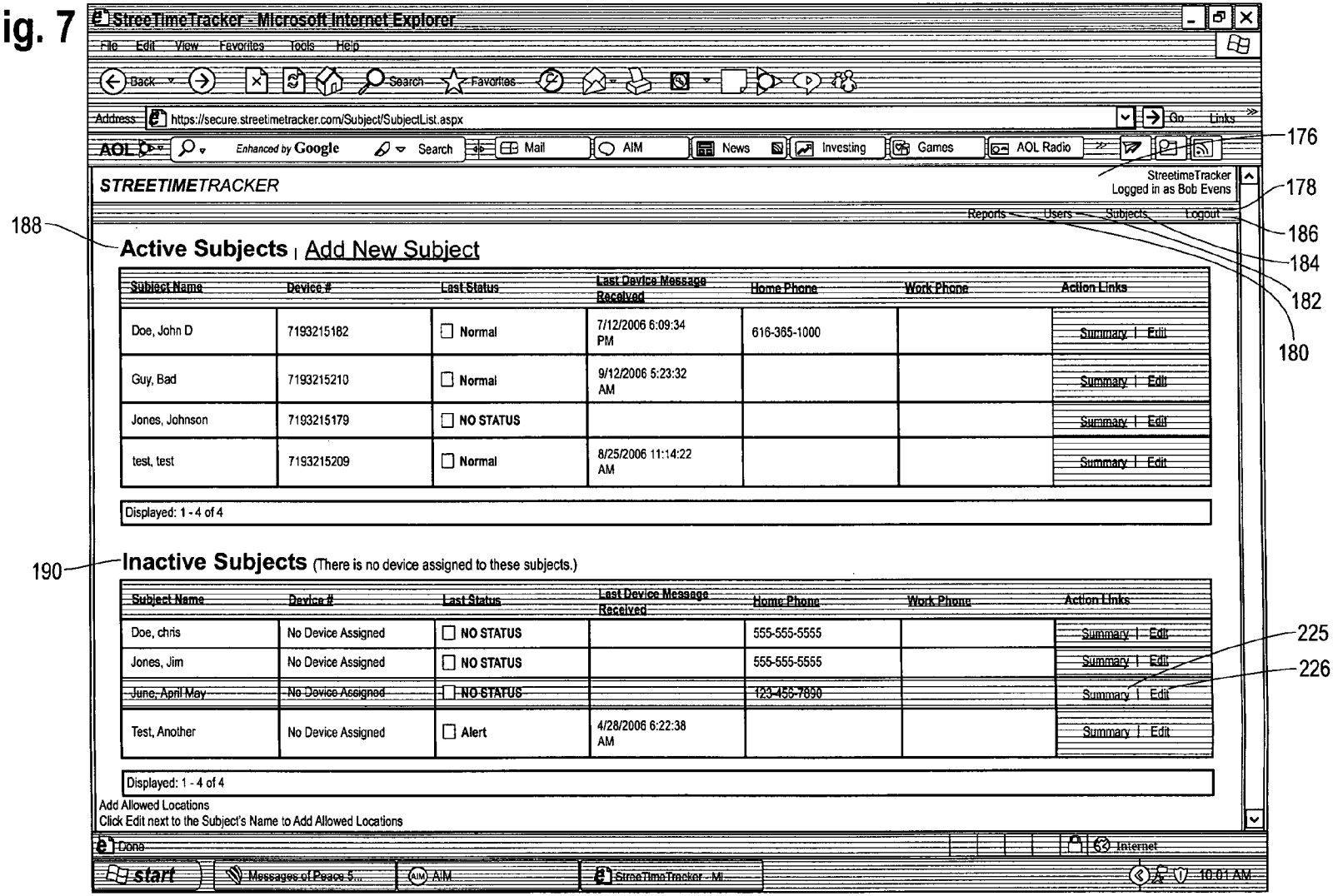
FIG. 7 is a diagram of the home interface screen depicting an example of a new offender added to the system.

The home interface screen 176, as illustrated in FIG. 7, depicts the new Offender 154 as entered into the system. Using the example of the new Offender 154 by the name of "April May June", this Offender 154 is initially entered as an inactive offender in the inactive subjects pane 190 with no device yet assigned.

When completed entering the new Offender 154 into the system, proceed to Step 105. In Step 105, the locations of where the Offender 154 will be permitted or allowed to live, work, visit, etc . . . and where the Offender 154 will not be permitted or is disallowed to live, work, visit, etc . . . are to be entered into the system. Collectively these locations and times, as discussed in more detail below, are referred to herein as the schedule or treatment plan for the Offender 154.

Figure 8:
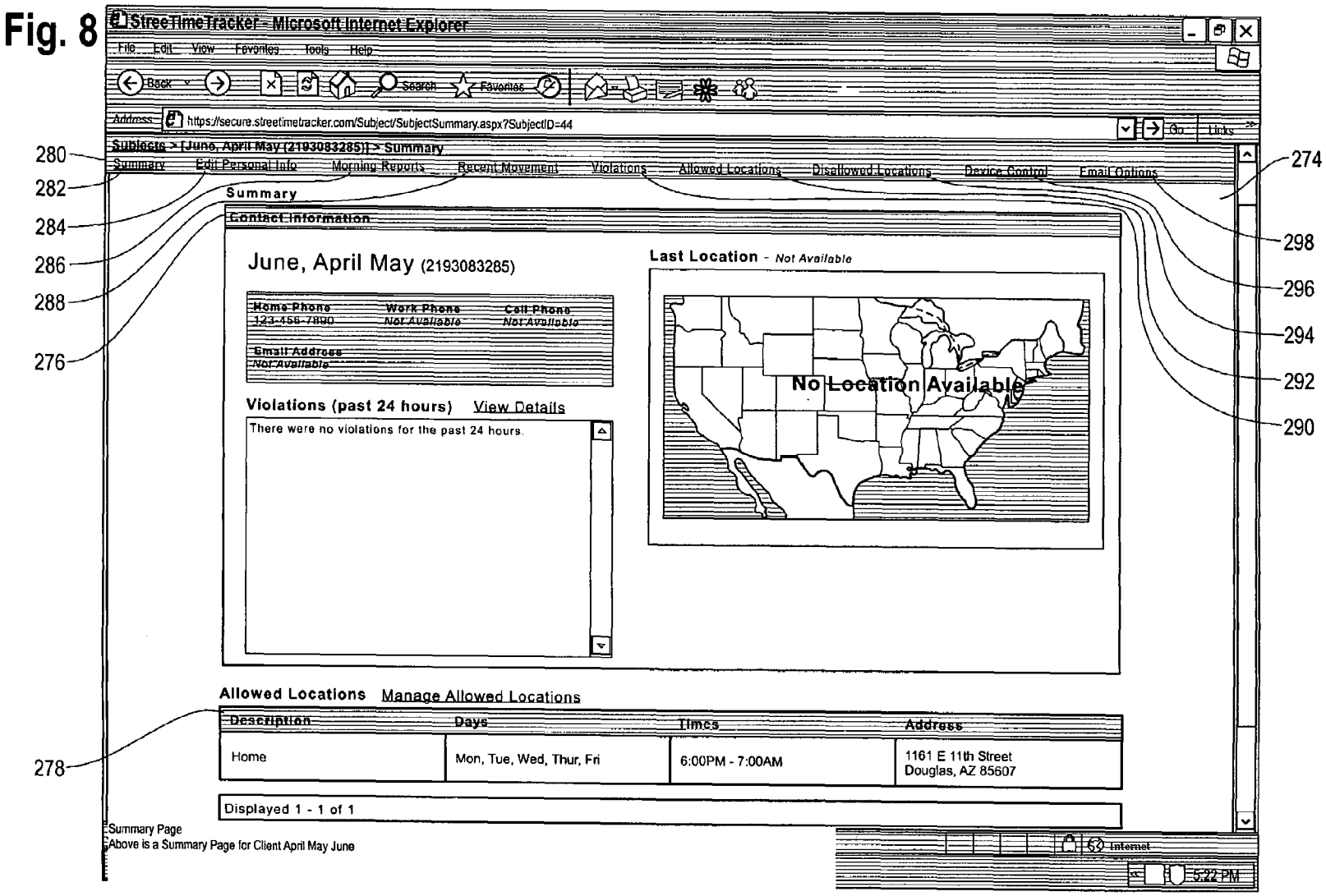
FIG. 8 is a diagram of the summary screen for the computer software system.

Selecting the summary link 225 adjacent to the offender's name proceeds to the summary screen 274, as illustrated in FIG. 8. Alternatively, selecting the edit link 226 adjacent to the offender's name likewise proceeds to the new location screen 228. The summary screen 274 provides a summary of the information for the selected Offender 154 using a contact information pane 276 and an allowed location pane 278. The summary screen 274 also provides a summary menu bar 280. The summary menu bar 280 provides a summary link 282, an edit personal info link 284, a morning reports link 286, a recent movement link 288, a violations link 290, an allowed locations link 292, a disallowed locations link 294, a device control link 296, and an email options link 298. Selecting the allowed locations link 292, proceeds to the new location screen 228, as illustrated in FIG. 9.

Figure 9:
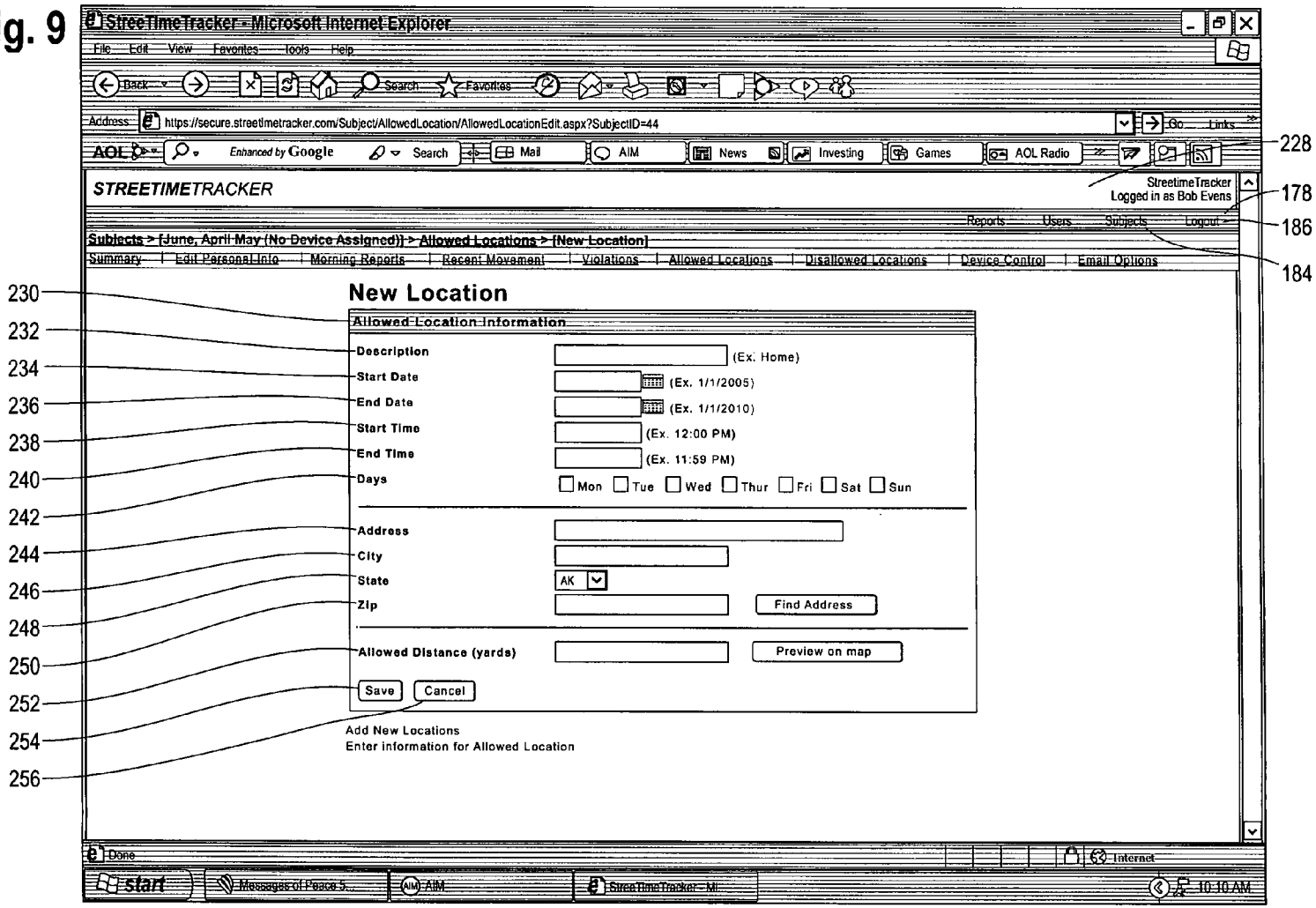
FIG. 9 is a diagram of the new location screen for the computer software system.

The new location screen 228, as illustrated in FIG. 9, provides an allowed location information pane 230. The allowed location information pane 230 provides the same menu bar 178 as previously described. The allowed location information pane 230 also provides a description prompt 232, a start date prompt 234, an end date prompt 236, a start time prompt 238, an end time prompt 240, a days prompt 242, an address prompt 244, a city prompt 246, a state prompt 248, a zip code prompt 250, an allowed distance prompt 252, and a save button 254 and cancel button 256.

Figure 10:
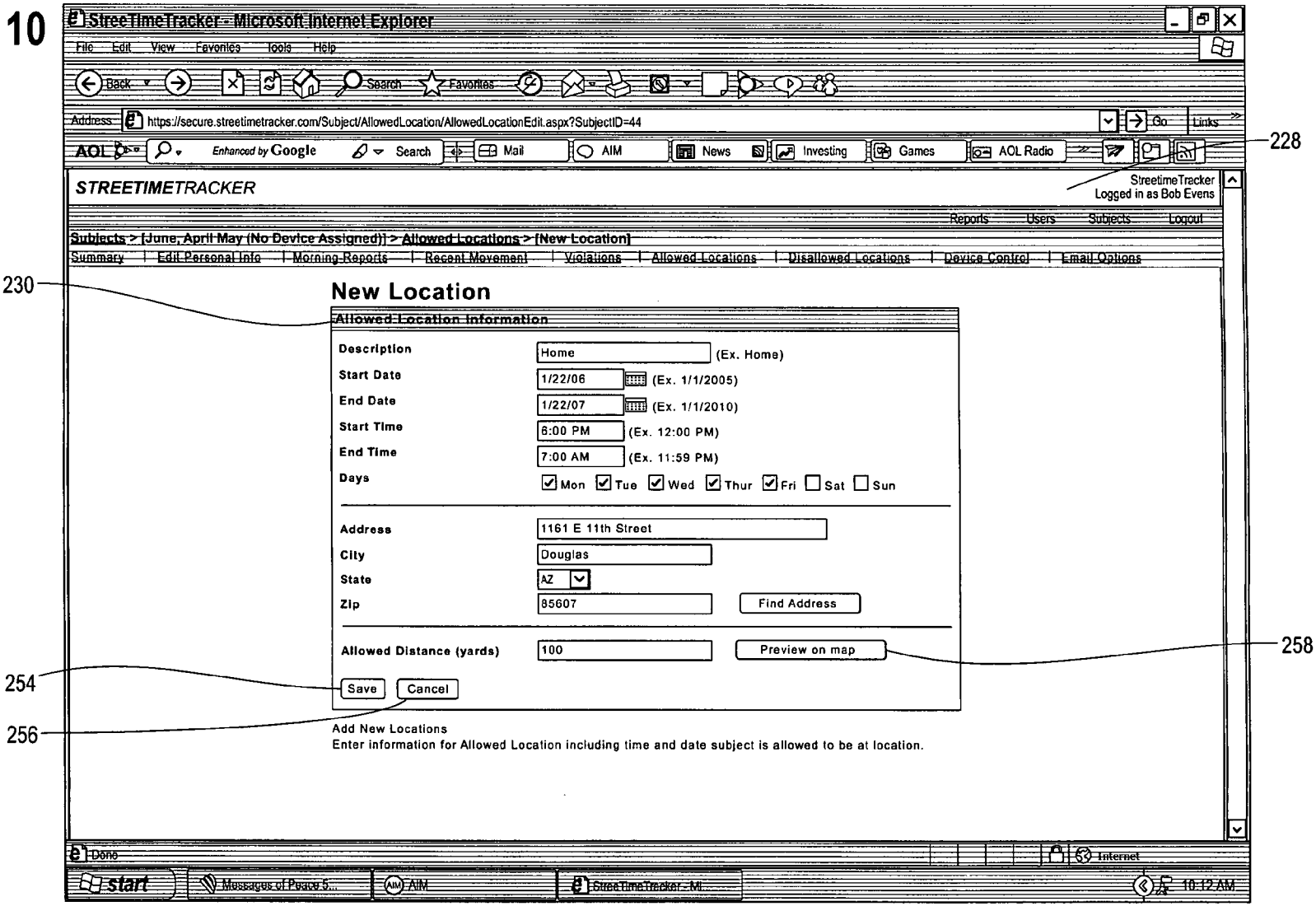
FIG. 10 is a diagram of the allowed location information pane of the new location screen for the computer software system.

To enter a permitted or allowed location for the schedule or treatment plan for the new Offender 154 into the system, enter the name of the permitted location in the description prompt 232. For example, as depicted, the name of one permitted location is typically the "home" of the Offender 154. Alternatively, the name of the permitted location may include but is not limited to work, doctor, rehabilitation center, or any other desired permitted location for the Offender 154. Enter the month, day, and year in the (mm/dd/yyyy) format into the start date prompt 234. This represents the day that the system will begin to monitor the Offender 154 for this particular location. Enter the month, day, and year in the (mm/dd/yyyy) format into the end date prompt 236. This represents the day that the system will stop monitoring the Offender 154 for this particular location. Enter the time in the (hh:mm am/pm) format into the start time prompt 238 and the end time prompt 240 and the day(s) of the week applicable for this particular location into the days prompt 242. This represents the time of the day and each day of the week (i.e., where a time of day is represented by any twenty-four hour (24 hr.) period during any seven (7) day week) when the Offender 154 is permitted or, in other words, required to be at this particular location to comply with their schedule or treatment plan. Enter the address, city, state, and zip code for this particular location into the respective like named prompts. This represents the exact address for the permitted location described in the description prompt 232. Enter the permitted or allowed distance into the allowed distance prompt 252. This represents the distance the Offender 154 is permitted to be from the allowed location to remain in compliance, as discussed in more detail below, with their schedule or treatment plan. Upon entering the above information, an example of an allowed location entered for the new Offender 154 by the name of "April May June" is illustrated in FIG. 10.

Figure 11:
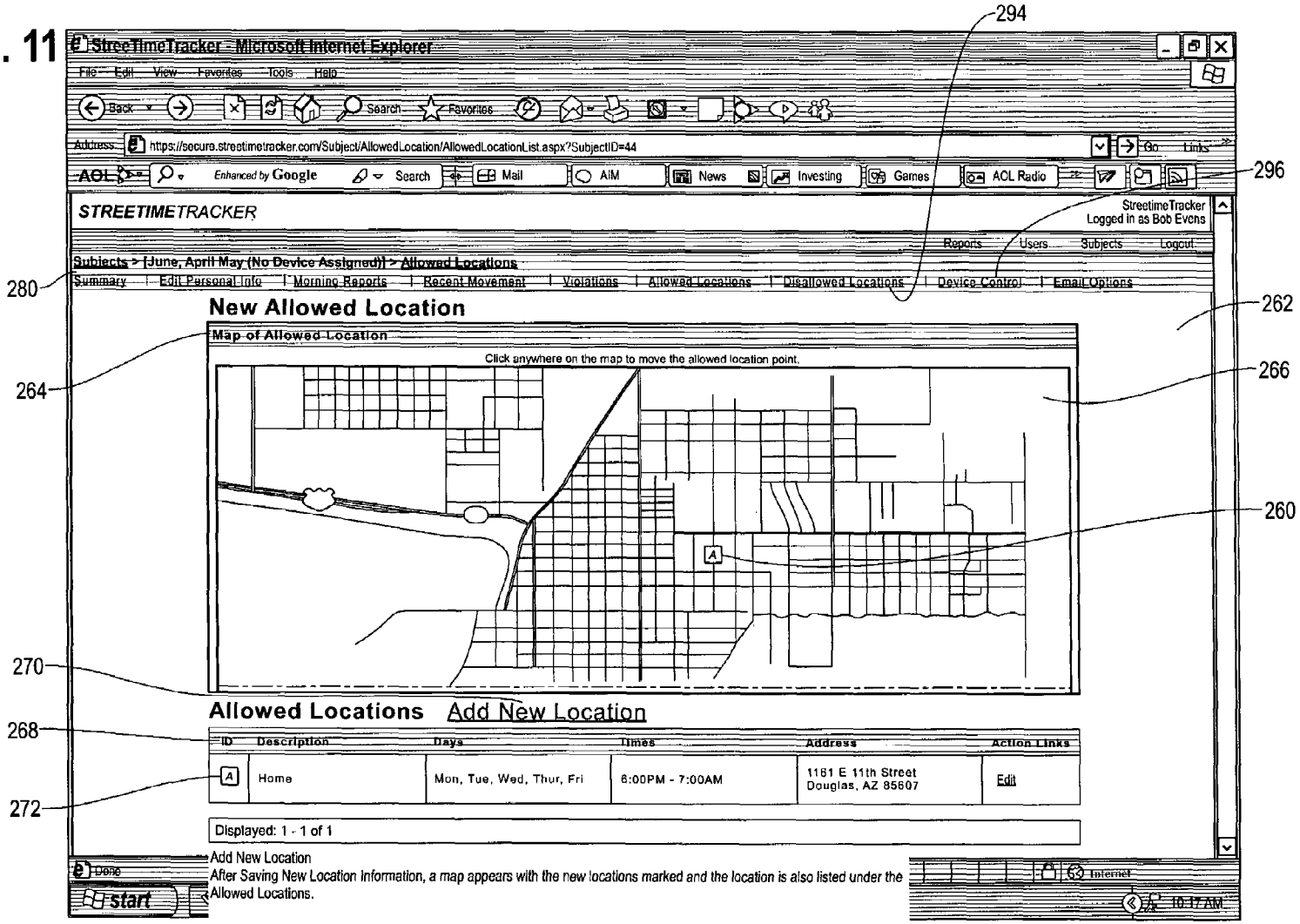
FIG. 11 is a diagram of the new allowed location screen for the computer software system.

Upon entering all of the information for this particular allowed location for the new Offender 154, selecting the save button 254 will save the information into the system and proceed to display a map of the location in a new allowed location screen 262, as illustrated in FIG. 11. Alternatively, selecting the preview on map button 258 will likewise display the map of the location in the new allowed location screen 262.

The new allowed location screen 262 provides the same summary menu bar 280 as previously described. The new allowed location screen 262 also provides a map of allowed location pane 264 and an allowed location id pane 268. The map of allowed location pane 264 depicts a map 266 which provides a location symbol 260, also identified by reference symbol A. This location symbol 260 or symbol A graphically represents where this new allowed location for the Offender 154 is on the map 266. The allowed location id pane 268 also depicts the textual information for this particular location as entered into the allowed location information pane 230. This textual information is identified by symbol 272 which directly corresponds to the location symbol 260 on the map 266. In this manner, each particular allowed location entered into the system is identified by a unique map symbol 260 which is identical to and referenced with the textual symbol 272.

In the preferred embodiment, an entire twenty-four hour (24 hr.) period of allowed locations should be entered for the new Offender 154 to avoid having a period of day and time where the Offender is not restricted to any schedule or treatment plan. Accordingly, if an entire twenty-four hour (24 hr.) period of permitted or allowed locations has not been entered for the new Offender 154 and is not shown in the allowed location id pane 268, selecting the add new location link 270 will allow the above steps to be repeated to add further allowed locations into the allowed location information pane 230 until an entire twenty-four hour (24 hr.) period of permitted or allowed locations has been entered for the new Offender 154.

When entering the allowed location information into the allowed location information pane 230, if any of the information was entered inadvertently, by mistake, or in error, selecting the cancel button 256 will cancel the action.

When completed entering all of the allowed locations for the Offender 154, proceed to Step 106. In Step 106, the locations of where the Offender 154 will not be permitted or is disallowed to live, work, visit, etc . . . is to be entered into the system. This can be very useful for prohibiting an Offender 154 such as pedofile from going to a school or park where children could be vulnerable. Selecting the disallowed locations link 294 from the summary menu bar 280 will proceed to enable all of the disallowed locations to be entered using screens in the same manner as the locations were entered for the allowed locations.

Figure 12:
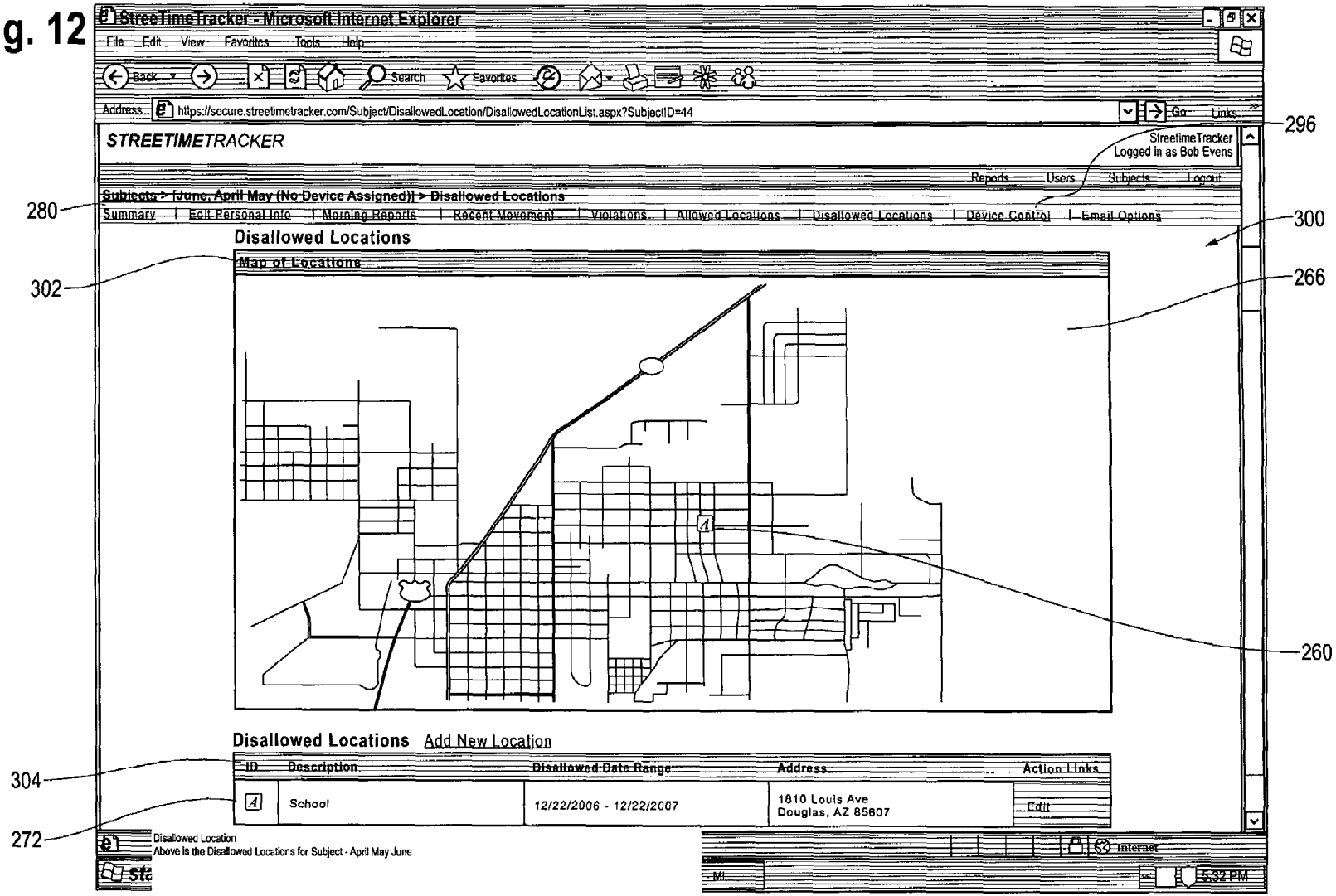
FIG. 12 is a diagram of the disallowed location screen for the computer software system.

When completed entering all of the disallowed locations for the Offender 154, an example of a disallowed location entered for the new Offender 154 by the name of "April May June" is illustrated in FIG. 12. The disallowed locations are displayed on a disallowed location screen 300 which provides a map of disallowed location pane 302 and a disallowed location id pane 304. The map of disallowed location pane 302 depicts a map 266 which provides a location symbol 260, also identified by reference symbol A. This location symbol 260 or symbol A graphically represents where the disallowed locations for the Offender 154 are on the map 266. The disallowed location id pane 304 also depicts the textual information for the locations as entered as a disallowed location. This textual information is identified by symbol 272 which directly corresponds to the location symbol 260 on the map 266. In this manner, each particular disallowed location entered into the system is identified by a unique map symbol 260 which is identical to and referenced with the textual symbol 272.

When completed entering all of the disallowed locations for the Offender 154, proceed to Step 107. In Step 107, a monitoring device 152 is assigned to the Offender 154. Selecting the device control link 296 from the summary menu bar 280 will proceed to the device control screen 306, as illustrated in FIG. 13. The device control screen 306 displays the controls for regulating the data between the global positioning means 150 and the monitoring device 152. The device control screen 306 provides a control panel pane 308. The control panel pane 308 provides a status message 310 and a command options pane 312. The command options pane 312 provides a buzz device option 314, a get GPS signal strength option 316, a lock band option 318, an unlock band option 320, and a set reporting frequency option 322.

Figure 14:
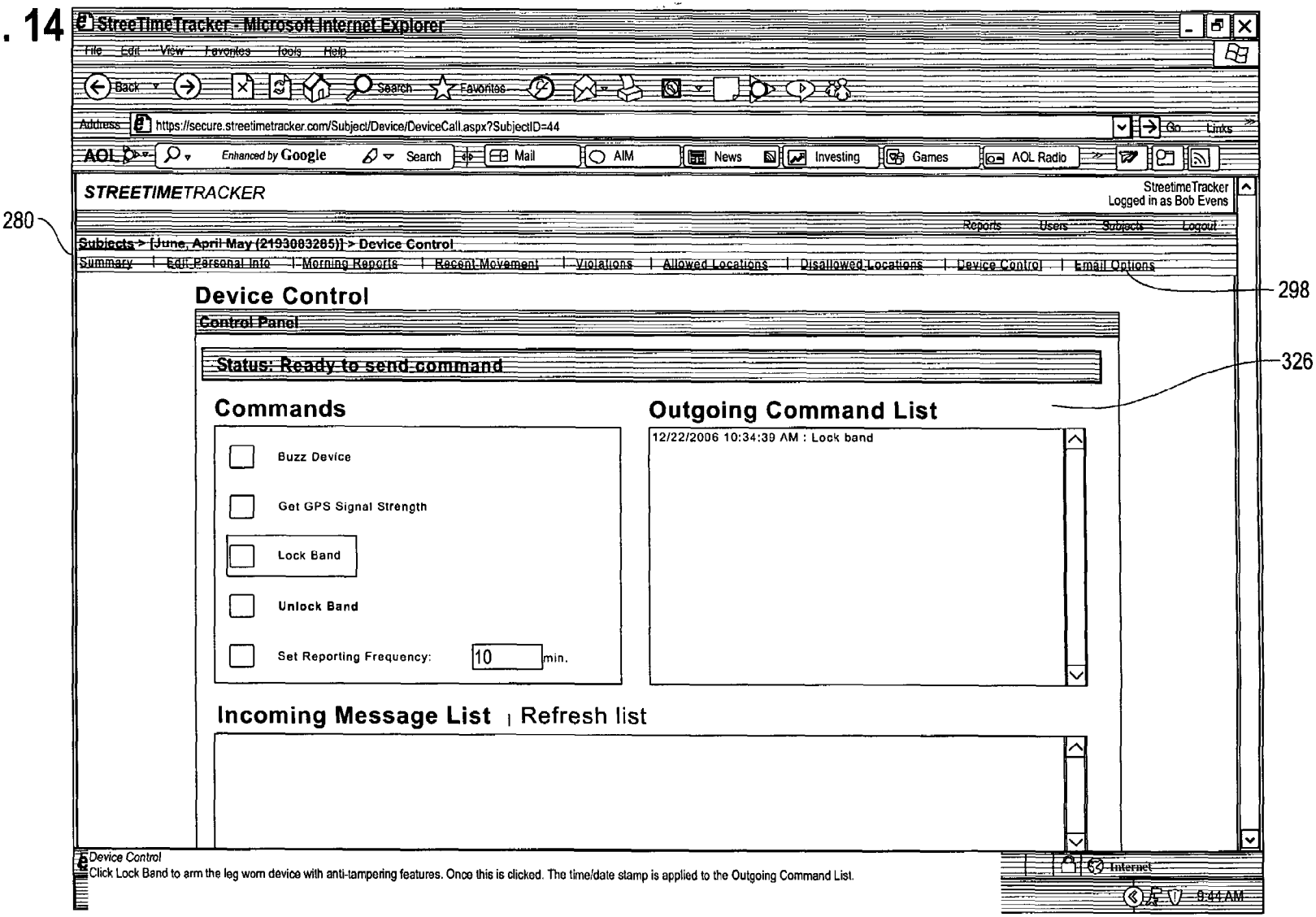
FIG. 14 is a diagram of the device control screen depicting the locking of the band of the monitoring device.

To begin to assign a monitoring device 152 to the Offender 154, the monitoring device 152, as described in more detail below, is secured to the Offender 154. The lock band option 318 is then selected. Once the lock band option 318 is selected, a time/date stamp is displayed in an outgoing command list 326, as illustrated in FIG. 14.

The set reporting frequency option 322 is then selected with a time frame entered into a minute box 324. The set reporting frequency is used to control how frequently the monitoring device 152 collects the positional location information from the global positioning means 150. In the preferred embodiment, the set reporting frequency is ten (10) minutes. Alternatively, the set reporting frequency can range anywhere from one (1) minute up to and including sixty (60) minutes.

The unlock band option 320 is selected or used when the Offender 154 successfully completes their conditional release program, is returned to Court ordered confinement for failing to comply with their conditional release program, or any other reason that the Offender 154 is no longer in the conditional release program or required to be monitored.

Figure 15:
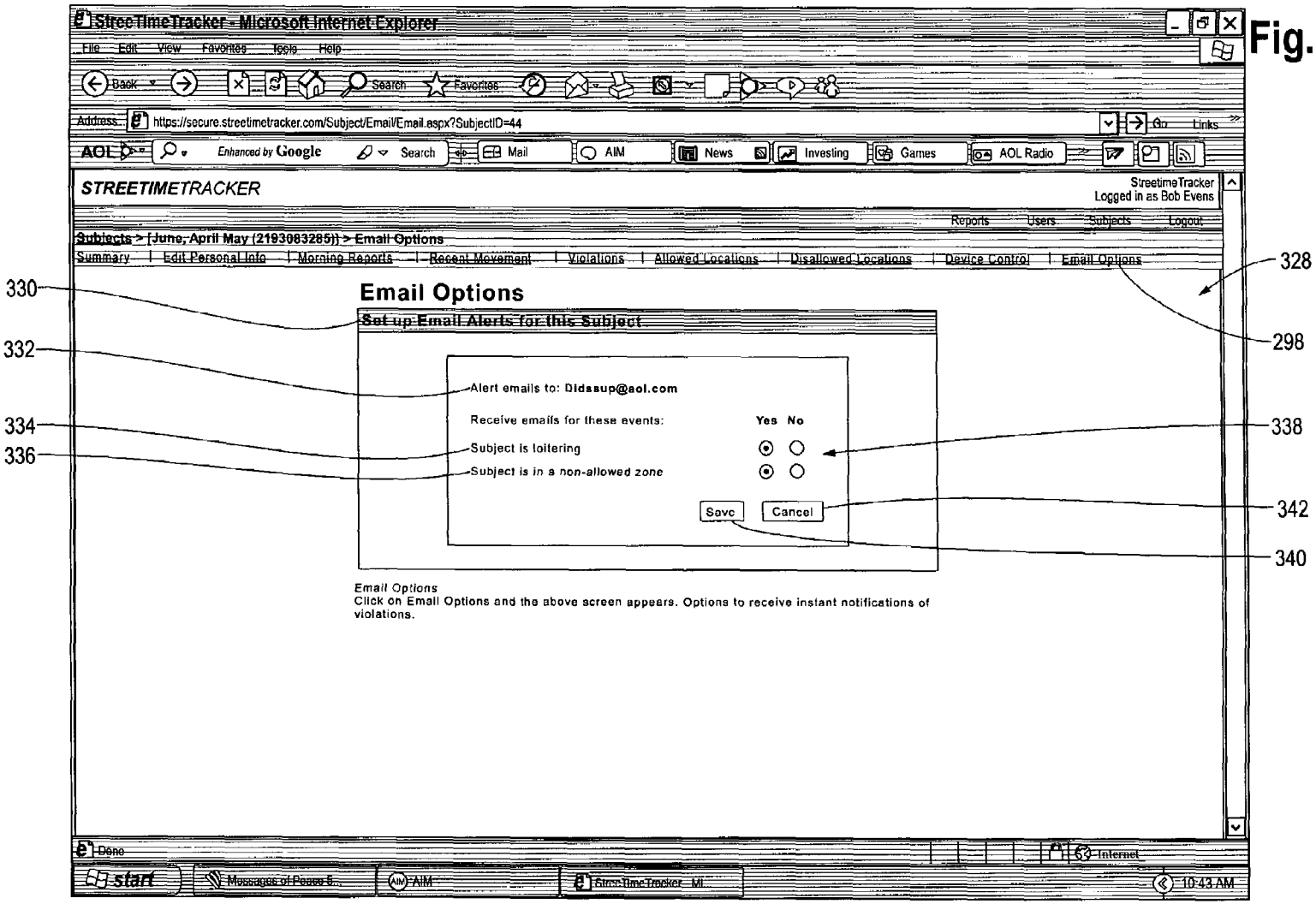
FIG. 15 is a diagram of the email options screen for the computer software system.

When completed assigning the monitoring device 152 to the Offender 154, proceed to Step 108. In Step 108, the email alerts for the Offender 154 are selected and entered into the system. Selecting the email options link 298 from the summary menu bar 280 will proceed to the email options screen 328, as illustrated in FIG. 15. The email options screen 328 enables various alerts to be configured for the Offender 154. The email options screen 328 provides an email options pane 330. The email options pane 330 provides an email notification prompt 332, a subject loitering alert selection 334 and a subject in a non-allowed zone alert selection 336. Adjacent to each selection is a circle 338 to select 'yes' or 'no' for the alert. If the subject loitering alert selection 334 is selected as 'yes', this will enable the analysis, as discussed in more detail below, to be conducted. If the subject in a non-allowed zone alert selection 336 is selected as 'yes', then any time the Offender 154 is in a disallowed location, an email alert will be sent to the email address provided in the email notification prompt 332. Selecting the save button 340 will save these selections into the system. Should any of selection be entered by mistake, or in error, selecting the cancel button 342 will cancel the action.

When completed configuring the email alerts for the Offender 154, proceed to Step 109. In Step 109, the monitoring or tracking of the Offender 154 begins with the monitoring device 152 is more clearly illustrated in FIGS. 16 and 17.

Figure 16:
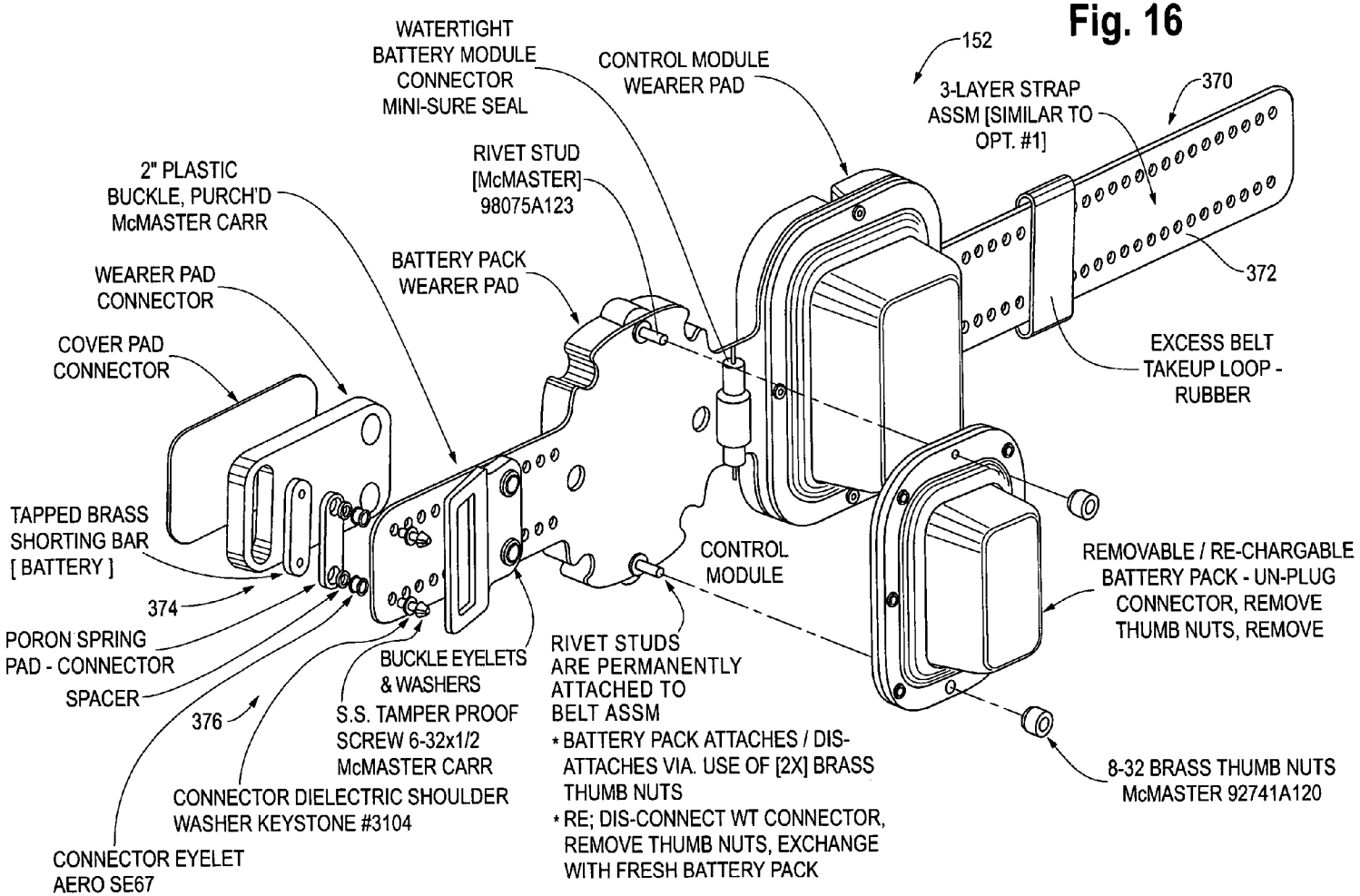
FIG. 16 is an exploded view of the band of the monitoring device.

Referring to FIG. 16, the monitoring device 152 provides a securing means 370. The purpose of the securing means 370 is to secure the monitoring device 152 to the Offender 154 being monitored. It is contemplated that the securing means 370 may be attached around the ankle, leg, wrist, arm, neck, and possibly the waist of the Offender 154. In this manner, the securing means 370 may be expanded to receive the desired body part of the Offender 154 and then released for constricting around that particular body part, thereby, securing the monitoring device 152 to the Offender 154. Alternatively, the securing means 370 may employ any means known to one skilled in the art for securing the monitoring device 152 to the Offender 370.

In the preferred embodiment, the securing means 370 is a continuous flexible band 372 and a locking means 374. Located within the securing means 370 is a tampering detection means 376 for determining if the Offender 154 is attempting the unauthorized removal of the monitoring device 152 from the body part. In the preferred embodiment, the tampering detection means 376 consists of an electrical wire and a temperature sensor wire, also referred to as thermistor 362 (see FIG. 17), that extend throughout the entire flexible band. The electrical wire provides a constant, closed loop, electrical circuit. If this circuit is disrupted or altered in any way by the Offender 154, the monitoring device 152 sends a notification to the system which in turn sends a notification to the customer. Also, the temperature sensor wire monitors the temperature of the Offender 154. Should the temperature of the Offender 154 be drastically disrupted, changed, or altered, the monitoring device 152 sends a notification to the system which in turn sends a notification to the customer Alternatively, the tampering detection means 120 may employ any means known to one skilled in the art.

Figure 17:
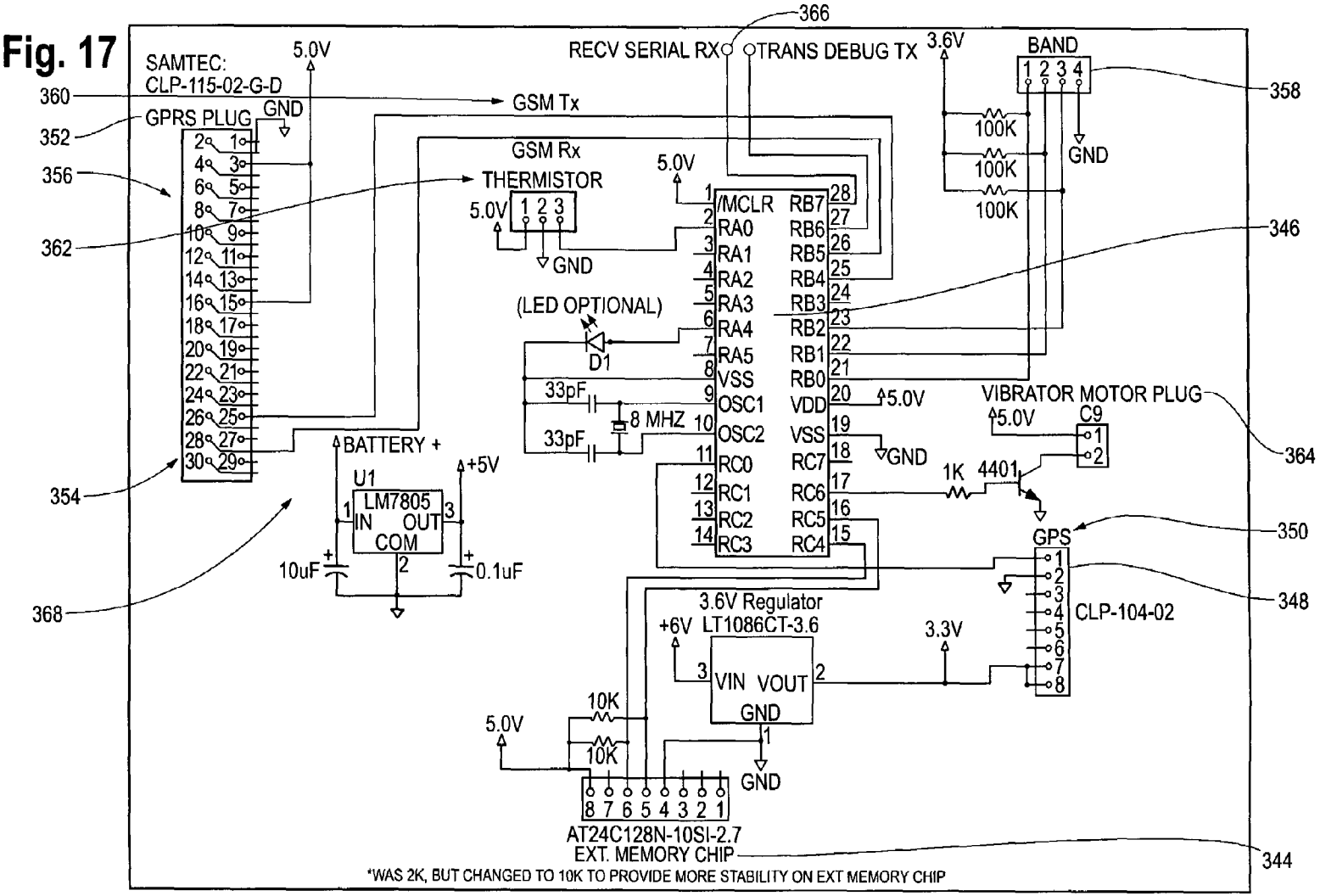
FIG. 17 is an electrical schematic diagram of the components used operate the monitoring device.

As illustrated in FIG. 17, the components of the monitoring device 152 are comprised of a memory chip 344 for controlling the operation and function of the monitoring device 152, a processor 346 for processing the commands from the memory chip 344, a global positioning means antenna 348 for receiving signals from the global positioning means 150 (see FIG. 1), a global positioning means module 350 such as the Lassen IQ Module #46240-00 or any other suitable module for obtaining and determining the position or location of the Offender 154 and any other necessary information, a cellular antenna plug 352 for receiving a cellular antenna that is used to receive and transmit cellular transmissions containing the information that is transferred from the monitoring device 152 to the email server 156 (see FIG. 1), a subscriber identity module (SIM) card drawer 354 for receiving a SIM card that is used to process the cellular transmissions received and transmitted through the cellular antenna, a cellular modem 356 such as the WaveCom Integra or Multitech Modem module #MTMMC-G-F2 or any other suitable cellular antenna for facilitating the cellular communication from the monitoring device 152 to the email server 156 through the cellular antenna, a male and female bands 358 for electrically activating the wires of the tampering detection means 376, a data band 360 for facilitating attachment of an external port for downloading information from the monitoring device 152, a thermistor 362 for registering the temperature of the Offender 154 wearing the monitoring device 152 and using this information for assisting in determining compliance with the treatment plan of the Offender 154 and for providing a backup security or tampering detection means, a vibrator means 364 for providing vibration communication to the Offender 154 wearing the monitoring device 152, a serial ground 366 to ground the electrical circuitry in the monitoring device 152, and a battery 368 for providing electrical power to the monitoring device 152 and all the operating components.

Using the monitoring device 152 described above, proceed to Step 110. In Step 110, the information relating to the positional location of the Offender 154 is collected. Referring back to FIG. 1, the monitoring device 152 receives the positional location information from the global positioning means 150. In the preferred embodiment, the global positional location information comprises the location of the monitoring device 152, the date, and the time. Alternatively, the date and time may be provided by the monitoring device 152 or adjusted by the monitoring device 152 to account for the proper time zone of the Offender 152. The location of the monitoring device 152 is typically in the form of Cartesian coordinates. Each positional location information received and collected by the monitoring device 152 is referred to as a "temporary entry."

In the preferred embodiment, the monitoring device 152 receives and collects a temporary entry every two (2) minutes. This is the default time period and referred to as the "reporting interval." This default reporting interval may be changed if the customer selects the set reporting frequency 322 and enters a time period, other than the default reporting interval, in the minute box 324 of the device control screen 306 (see FIG. 13). For each reporting interval, a positional location information is then received and collected from the global positioning means 150 and the temporary entry is created. This collection of temporary entries is referred to as "a set of temporary entries." The monitoring device 152 also collects, using the thermistor 362, the body temperature of the Offender 152, and any other applicable notifications including but not limited to "band breach" if the securing means 370 or the tampering detecting means 376 have been breached, temperature alert if the body temperature of the Offender 152 becomes unusual, any biometric information as discussed below, if applicable, and/or any other desired notifications. The collection of this data is referred to as "information."

The monitoring device 152 then transfers the set of temporary entries to the e-mail server 156. In the preferred embodiment, the monitoring device 152 transfers the set of temporary entry every ten (10) minutes. In this manner, the set of temporary entries contains a total of five (5) temporary entries. This is the default time period and referred to as the "reporting frequency." This default reporting frequency may be changed if the customer selects the reporting frequency margin 220 of the add new subject information pane 196 and enters a time period, other than the default reporting frequency (see FIG. 5). The email server 156 then transfers the information to the web/application server 158. This completes Step 110, proceed to Step 111. In Step 111, the set of temporary entries of the positional location information for the Offender 154 is then analyzed by the software 162.

In the preferred embodiment, to begin the analysis, proceed to Step 112. In Step 112, the set of temporary entries is first analyzed to determine if the Offender 154 is loitering or, in other words, remaining in substantially the same location for a certain period of time and therefore considered to be in an "area of interest." In the preferred embodiment, the locational range is within approximately one-hundred (100) feet for a time period of ten (10) minutes. Using the set of temporary entries, loitering is determined. In the preferred embodiment, as there are a total of five (5) entries totaling a ten (10) minute period, each subsequent entry in the set, starting with the second entry, is compared to the prior entry. If the location from the five entries is exact same or substantially the same location (i.e., all within approximately one-hundred (100) feet of one another), the Offender 154 is considered to be in an "area of interest." The reason this location is considered an area of interest is that the Offender 154 is now considered to be loitering in this particular location for some reason and may, if not reviewed further, be posturing to re-commit an illegal activity or violate their schedule or treatment plan. If the Offender 154 is in an area of interest, proceed to step 113.

If the location from the five entries are not the same or substantially different location (i.e., all are not within approximately one-hundred (100) feet of one another), the Offender 154 is not considered to be in an "area of interest", proceed to Step 114.

In Step 113, since the Offender 154 is in an area of interest, the analysis continues to determine if the Offender 154 is in an "approved location." Once it is determined that the individual is in an "area of interest", their location is compared to their allowed locations to determine if the Offender 154 is in compliance with their schedule or treatment plan for that relevant time period (i.e., date and time). If the Offender 154 is at the allowed location for that relevant time period or within the allowed distance 252 of that allowed location (see FIG. 9), the Offender 154 is in compliance with their schedule or treatment plan. If, however, the Offender 154 is not at the allowed location for that relevant time period or within the allowed distance 252 of that allowed location, the Offender 154 is not in compliance with their schedule or treatment plan. As a result, the Offender 154 is deemed to be in violation of their conditional release program. When this analysis is completed, proceed to Step 114.

Figure 18:
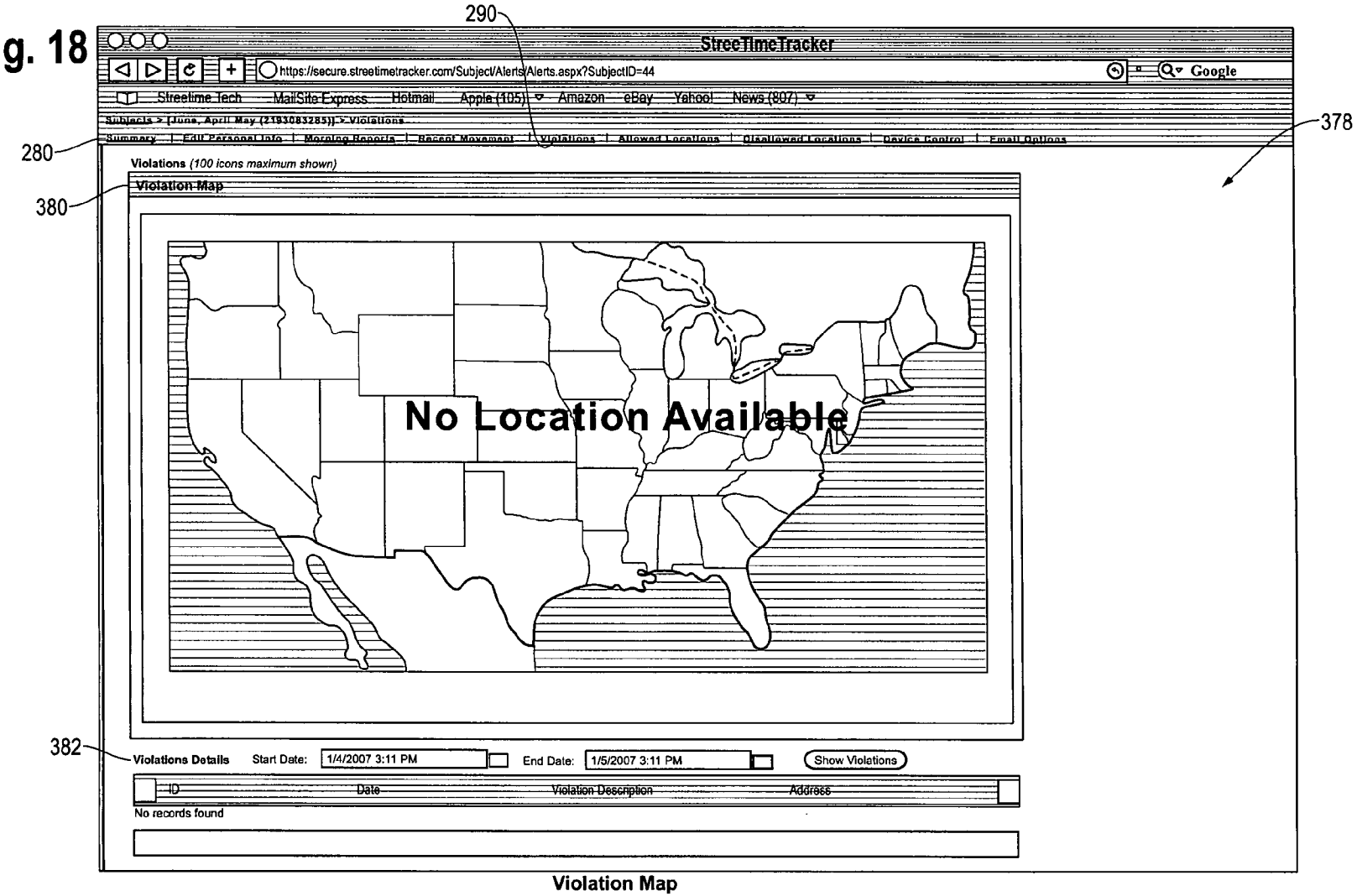
FIG. 18 is a diagram of the violation report screen for the computer software system.

In Step 114, a violation report 378 of the analysis, as illustrated in FIG. 18, is generated. The violation report 378 provides a violation map 380 and violation details 382. Where the Offender 154 is not found to be in an "area of interest" and/or the Offender 154 is found to be in an "area of interest" and in compliance with their schedule or treatment plan, the violation map 380 will provide "no location available" and the violation details 382 will provide "no records found" indicating that no violations have been committed by the Offender 154. In the preferred embodiment, the violation report 378 is created into a ".pdf" file format. Alternatively, the violation report 378 may be created in any acceptable file format that is known to one skilled in the art.

Where an Offender 154 is in an "area of interest" and found not to be in compliance with their schedule or treatment plan, the violation report 378 will depict the location of the Offender 154 when the violation occurred on the violation map 380 and a corresponding textual entry in the violation details 382. In this manner, the non-compliance or violation of the conditional release program by the Offender 154 is reported. At any time, the customer may then select the violations link 290 from the summary menu bar 280 to review this violations report 378 for the Offender 154 and take any appropriate action the customer deems necessary. When the reports are completed, proceed back to Step 110 and repeat the same steps for the next set of temporary entries. In this manner, the violation report 378 will be continually updated after each next succession of review and analysis.

In the preferred embodiment, when the review and analysis is conducted over the course of one full day or a twenty-four (24) hour period for the Offender 154, proceed to Step 115.

In Step 115, upon completion of the twenty-four (24) hour period, a morning report 384, as illustrated in FIGS. 19*a* and 19*b*, is completed and generated. The morning report 384 provides a log entries pane 386 identifying the number of violations that the Offender 154 occurred during that twenty-four (24) hour period, contact information pane 388, morning notes pane 390 identifying any information such as information from the monitoring device 152, allowed areas pane 392 providing all of the allowed locations for the Offender 154, disallowed areas pane 394 providing all of the disallowed locations for the Offender 154, the violation map 380, a violation log pane 396, a movement map 398, a movement log pane 400, and an information log pane 402.

In the preferred embodiment, the movement map 398 monitors a location of the Offender 154 for each hour of the twenty-four (24) hour period resulting in twenty-four (24) map points 404, also represented by numerical numbers 406. The map points 404 collectively provide a "snail trail" of the general movement of the Offender 154 over the twenty-four (24) hour period. The beginning or first location of the Offender 154 is identified by numeral #1, the location of the second location at the second hour by numeral #2, and so on up to and including the twenty-fourth location and hour to be identified by numeral #24. If the movement map 398 is too general with respect to the location of any particular map point 404, selecting the map point 404 will display a more detailed, localized map of that location. When the morning report is completed, proceed to Step 116.

In Step 116, the web/application server 158 sends the morning report 384 to the customer responsible for the Offender 154. In the preferred embodiment, the customer will receive the morning report 384 on their customer computer 160 via e-mail communication. In addition, if the customer selects the morning reports link 286 from the summary menu bar 280, a subject's morning reports pane 408, as illustrated in FIG. 20, will be displayed. The subject's morning reports pane 408 provides an entry 410 for each twenty-four (24) hour reporting period. In a non-limiting example, sixteen or seventeen entries are displayed. By selecting the corresponding view report link 412, the morning report 384 (see FIGS. 19*a* and 19*b*) is provided for that particular reporting period.

This process continues until the Offender 154 successfully completes their conditional release program, is returned to Court ordered confinement for failing to comply with their conditional release program, or any other reason that the Offender 154 is no longer in the conditional release program or required to be monitored.

Biometric Means

Alternatively, it is contemplated by the Applicant that the monitoring device 152 does not need to be worn, secured, or attached to the body of the Offender 154. In this alternate embodiment, with the exception of the securing means 370 and the tampering detection means 376, the remaining components of the monitoring device 152 remain the same. For example, in one non-limiting example, the monitoring device 152 may be a mobile unit, integrated into a mobile cellular phone, or any other form of detached mobile unit.

As there is no securing means 370 or tampering detection means 376, the monitoring device 152 uses biometric means such as biometric sensing devices to confirm the Offender's compliance with their conditional release program. The monitoring device 152 either contains the biometric means such as the biometric sensing devices or wirelessly communicates with such devices. If the monitoring device 152 is worn off the body, meaning it is not physically attached to the body, it can be clipped to the Offender's clothing, placed in the Offender's pocket, purse, or in any other position in close proximity to the Offender. Using the biometric sensing devices, the biometric information of the Offender is used as the means to validate that the Offender being tracked is, in fact, the same person that is supposed to be monitored by the monitoring device 152.

To activate or use this biometric means, the biometric information of the Offender 154 is entered into the system. This includes but is not limited to recording the Offender's answers to a series of questions, recording the audio of the Offender's voice, recording the fingerprints of the fingers of the Offender's left or right hands, and/or recording the photograph of the Offender. This biometric information is then stored in the system for later comparison and validation. Randomly throughout a twenty-four hour (24 hr.) period, the system would send a communication to the monitoring device 152 requesting that the Offender verify themselves. As the monitoring device 152 provides a voice recorder, a fingerprint reader, and/or a camera or, alternatively, wirelessly communicates with such biometric devices, the Offender, pursuant to the request, uses the voice recorder to answer a series of questions in their voice, uses the fingerprint reader to record a particular fingerprint of the Offender's left or right hand or both, and/or uses the camera to record the photograph of the Offender. Each or all of this biometric information could be requested in the communication. Upon recording the requested biometric information, the monitoring device 152 sends this recorded biometric information to the system. The system then compares this recorded biometric information against the previously recorded and stored biometric information for the Offender. Upon completion of the comparison, if the recorded biometric information matches the previously recorded and stored biometric information for the Offender, the Offender is confirmed and validated. If the Offender is not confirmed and validated, the system sends a notification to the customer.

Voice Service Means

The voice service means allows the customer and/or the Offender 154 to audibly communicate with the system or use the system to communicate with one another. Preferably, the voice service means is fully integrated into the web based system described above. For example, Microsoft Speech Server could be used to enable the system to audibly communicate with the customer and/or Offender 154. In this manner, the system audibly enables the customer or Offender 154 access to the same data that otherwise is available through the web based system described herein.

To begin to access and use the voice service means, a customer and/or an Offender 154 are required to login to the system. To login to the system, the customer and/or Offender 154 are required to provide the proper login credentials. The system will prompt the customer or Offender 154 to say or enter (via the touch pad) their numerical id and their numerical pin. Both numbers are to be between four (4) and six (6) digits. Preferably, these numbers are not the same. Once logged into the system, the customer or Offender 154 are provided with a main menu of options from which to choose and make a selection.

Before a customer can proceed with any menu options for a particular offender, the customer first must select an offender. For example, the system will allow the customer to say any part of the name of the offender or a number for that offender which the system can use to search for a match. If any results are found, the system will state how many were found and then begin listing them in order (i.e, best match to worst match). Best match may be from an offender number, then from last name, and then from first name. When the customer hears the number or name of the offender they are seeking, the customer can select that offender by saying "select", or pressing # on the key pad, or any other suitable means. By selecting an offender, the customer can then take further action with respect to that particular offender.

The main menu of options includes but is not limited to the following:

(a) Offender Location. When this option is selected, the system will speak the most recent or last known location of the offender. The system will also speak the date and time that this location was acquired.

(b) Page Offender. When this option is selected, the system will send the page (vibrate) command to the monitoring device 152 assigned to the offender. The system will verbally confirm that the command was sent successfully or not (this is not to be interpreted as assurance that the monitoring device 152 received and executed the command, only that the message was sent).

(c) Dial offender. When this option is selected, the system will automatically initiate a phone call to the offender without the caller's intervention. Should the offender have more than one phone number, the customer can select from the primary or any other listed phone number for the offender. The numbers will be listed by name, primary, cell phone, home phone, parent's home phone, etc . . .

(d) Violation List. When this option is selected, the system will verbally state how many violations and possible violations have occurred in the past 24 hours for the offender. As each violation is listed, the customer can request more details by stating a command such as "select", entering # on the keypad, or any other suitable command. The details of the violation and what specifically is stated as the violation list is verbalized.

(e) Messages List. This list is effectively the voice mail that can be left by an offender. When this option is selected, the system will act like a typical voice mail system, allowing the customer to listen to messages and archive them (meaning they will only be available in the web based system).

(f) Set offender. When this option is selected, the system will enable various options for modifying the offender's information and schedule.

(g) Language selection. When this option is selected, the system will prompt the user to say or enter a command if they wish to use the English, Spanish, or any other language features.

(h) Respond to Page. When this option is selected, the system will verbalize instructions and then beep, indicating that the offender may now record their explanation regarding whey they think they were paged. When complete they will have to enter a command with the keypad such as # or any other suitable command. The results of this voice recording will be made available to the customer within the web based application and also within the "Messages List" feature of the voice enabled system.

(i) Request work schedule change. When this option is selected, the system will verbalize instructions and then beep, indicating that the offender may now record their request to have their work schedule changed. This results in a request to the customer to make a change but does not affect the actual schedule until approved by the customer. When complete, the offender will have to enter a command with the keypad such as # or any other suitable command. The results of this voice recording will be made available to the offender within the web based application and also within the 'Messages List' feature of the voice enabled system.

Other Features

In addition, it is contemplated by the Applicant that the monitoring device 152 can have the ability to contain the Offender's schedule and there could be a link between the Offender's schedule in the system and that which is in the monitoring device 152. The monitoring device 152 can have the ability for the Offender 154 to keep a treatment diary of their emotional responses they are feeling throughout the day. This could range from using the monitoring device 152 to fill out an online form, to entering a numeric code into the monitoring device 152, to writing journal entries into the monitoring device 152. The monitoring device 152 can have the ability to wirelessly communicate with other devices. The monitoring device 152 can include pulse and blood pressure sensors, breathalyzer equipment, or devices that sense motion. Wireless sensors for pulse and blood pressure may be used to screen (to know when to test) for indications of drug or alcohol use. Monitoring these vital signs can also assist in assessing possible behaviors that would interest the customer. The monitoring device 152 can have the ability to communicate to a breathalyzer attached to an Offender.

The monitoring device 152 and the system can also incorporate the automated system and method for determining drug testing as disclosed by Applicant in U.S. patent application Ser. No. 11/449,176.

Thus, there has been provided a unique method and apparatus for monitoring or tracking an individual's compliance with the conditional release program from their court ordered confinement. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the invention.

What is claimed is:

1. A method for monitoring a person, comprising the steps of:

(a) creating a schedule for the person;

(b) beginning to monitor the person using a monitoring device from a starting time to an ending time;

(c) collecting a positional locations for the person at each reporting interval over an initial reporting frequency period from the starting time, the positional locations collected during this initial reporting frequency period defining a first set of positional locations;

(d) transferring the first set of positional locations for the person from the monitoring device to a computer;

(e) conducting a loitering test during the initial reporting frequency period using the following steps:

(i) analyzing each of the positional locations collected at each reporting interval during the initial reporting frequency period by comparing each subsequent positional location to the previous positional location;

(ii) providing that if each subsequent positional location during the initial reporting frequency period is at the same location or all of the positional locations collected during the initial reporting frequency period are within a locational range from one another, the person is loitering, and comparing the first set of positional locations to the schedule if the person is loitering;

(iii) providing that if each subsequent positional location during the initial reporting frequency period is not at the same location or all of the positional locations during the initial reporting frequency period are not within the locational range from one another, the person is not loitering, and skipping any comparison of the first set of positional locations to the schedule if the person is not loitering:

(f) collecting the positional location for the person at each reporting interval over each next subsequent reporting frequency period until the ending time;

(g) repeating the loitering test for each next subsequent reporting frequency period until the ending time; and (h) generating a report of the analysis from the starting time to the ending time.

2. The method of claim 1 and further comprising the step of entering at least one allowed location into the schedule for the person.

3. The method of claim 2 and further comprising the step of making the at least one allowed location for the person active during a plurality of days of the week and a time period for each of the plurality of days of the week.

4. The method of claim 3 and further comprising the step of selecting the plurality of days of the week from the group consisting of Monday, Tuesday, Wednesday, Thursday, Friday, Saturday, and Sunday.

5. The method of claim 4 and further comprising the step of providing that the time period for each of the plurality of days of the week covers a total of twenty-four hours for each day of the week.

6. The method of claim 1 and further comprising the step of entering at least one disallowed location into the schedule for the person.

7. The method of claim 1 and further comprising the step of assigning the monitoring device to the person.

8. The method of claim 1 and further comprising the step of securing the monitoring device to the person.

9. The method of claim 8 and further comprising the step of reporting the occurrence of any tampering with the monitoring device.

10. The method of claim 1 and further comprising the step of providing that the reporting interval is every two minutes.

11. The method of claim 1 and further comprising the step of providing that the reporting frequency period is every ten minutes.

12. The method of claim 1 and further comprising the step of providing that the locational range is one hundred feet.

13. The method of claim 1 and further comprising the step of comparing, where the person is loitering, each of the positional locations to the at least one allowed location for the person.

14. The method of claim 13 and further comprising the step of providing that if any of the positional locations are at the at least one allowed location or are within an allowed distance from the at least one allowed location, the person is in compliance with the schedule.

15. The method of claim 13 and further comprising the step of providing that if any of the positional locations are not at the at least one allowed location or are not within an allowed distance from the at least one allowed location, the person is not in compliance with the schedule.

16. The method of claim 1 and further comprising the step of sending the report to an appropriate authority responsible for the person.

17. A computer based method for monitoring a person, comprising the steps of:

if the person is to be monitored, then performing the following steps (a)-(b):

(a) entering at least one allowed location into a schedule for the person;

(b) making the at least one allowed location for the person active during a plurality of days of the week and a time period for each of the plurality of days of the week;

if the schedule is created for the person, then performing the following step (c):

(c) beginning to monitor the person using a monitoring device;

if the person is being monitored, then performing the following steps (d)-(e):

(d) collecting a plurality of positional locations for the person over a reporting frequency;

(e) transferring the positional locations for the person from the monitoring device to a computer;

if the plurality of positional locations are to be analyzed to determine if the person is in compliance with the schedule, then performing the following steps (f)-(l):

(f) analyzing the plurality of positional locations collected over the reporting frequency;

(g) comparing each subsequent positional location to the previous positional location for the reporting frequency;

(h) providing that if each subsequent positional location over the reporting frequency is at the same location or all of the positional locations are within a locational range from one another, the person is loitering;

(i) comparing each of the positional locations to the at least one allowed location for the person;

(j) providing that if any of the plurality of positional locations are at the at least one allowed location or are within an allowed distance from the at least one allowed location, the person is in compliance with the schedule;

(k) providing that if each subsequent positional location over the reporting frequency is not at the same location or all of the positional locations are not within the locational range from one another, the person is not loitering;

(l) skipping any comparison of the positional locations to the schedule if the person is not loitering;

if the results of the analysis are to be reported, then performing the following steps (m):

(m) generating a report of the analysis.

* * * * *